US005590719A

United States Patent [19]

McLoughlin et al.

[11] Patent Number: 5,590,719

[45] Date of Patent: Jan. 7, 1997

[54] FIREFIGHTING NOZZLE WITH FOAM INJECTION SYSTEM

[76] Inventors: John E. McLoughlin, 26 Southern Blvd., Nesconset; Neocles G. Athanasiades, 6 Maybeck Dr., East Setauket, both of N.Y. 11767

[21] Appl. No.: 161,482

[22] Filed: Dec. 6, 1993

Related U.S. Application Data

[63] Continuation-in-part of Ser. No. 50,974, Apr. 19, 1993, Pat. No. 5,447,203, which is a continuation-in-part of Ser. No. 731,492, Jul. 17, 1991, Pat. No. 5,261,494.

[51] Int. Cl.[6] ..... A62C 31/12

[52] U.S. Cl. ..... 169/70; 169/13; 239/310; 239/414

[58] Field of Search ..... 169/5, 13, 14, 169/15, 70; 239/310, 414, 415, 416.2, 417.5; 137/99, 606, 607

[56] References Cited

U.S. PATENT DOCUMENTS

| | | | |
|---|---|---|---|
| 2,089,646 | 8/1937 | Friedrich | 169/15 X |
| 2,130,745 | 9/1938 | Rosenbauer | 169/15 |
| 3,607,779 | 9/1971 | King et al. | 169/15 X |
| 5,261,494 | 11/1993 | McLoughlin et al. | 169/70 |

*Primary Examiner*—Andrew C. Pike
*Attorney, Agent, or Firm*—Louise S. Heim

[57] ABSTRACT

A firefighting nozzle includes a nozzle body having a having a centrally formed jet orifice at its outlet end. An annular fog spray opening concentrically surrounds the jet orifice. A jet control valve is provided for allowing selective variation of the diameter of the solid stream emitted from the jet orifice. A fog control valve is provided for selectively varying the intensity of the discharge from the fog spray opening. The jet control valve and the fog control valve are operable independently of and simultaneously with one another, so that either a variable diameter solid stream or a variable fog cone, or both, can be produced at once. Various remote control arrangements are available for actuating the jet and fog control valves. Foam injection systems are provided for inducing a foam concentrate at a low-pressure point within the nozzle. Accessories for securing the nozzle to a fixed object, for changing the direction of spray, and for allowing a hose to be lifted to reach otherwise inaccessible areas are also provided.

9 Claims, 15 Drawing Sheets

FIG. 6
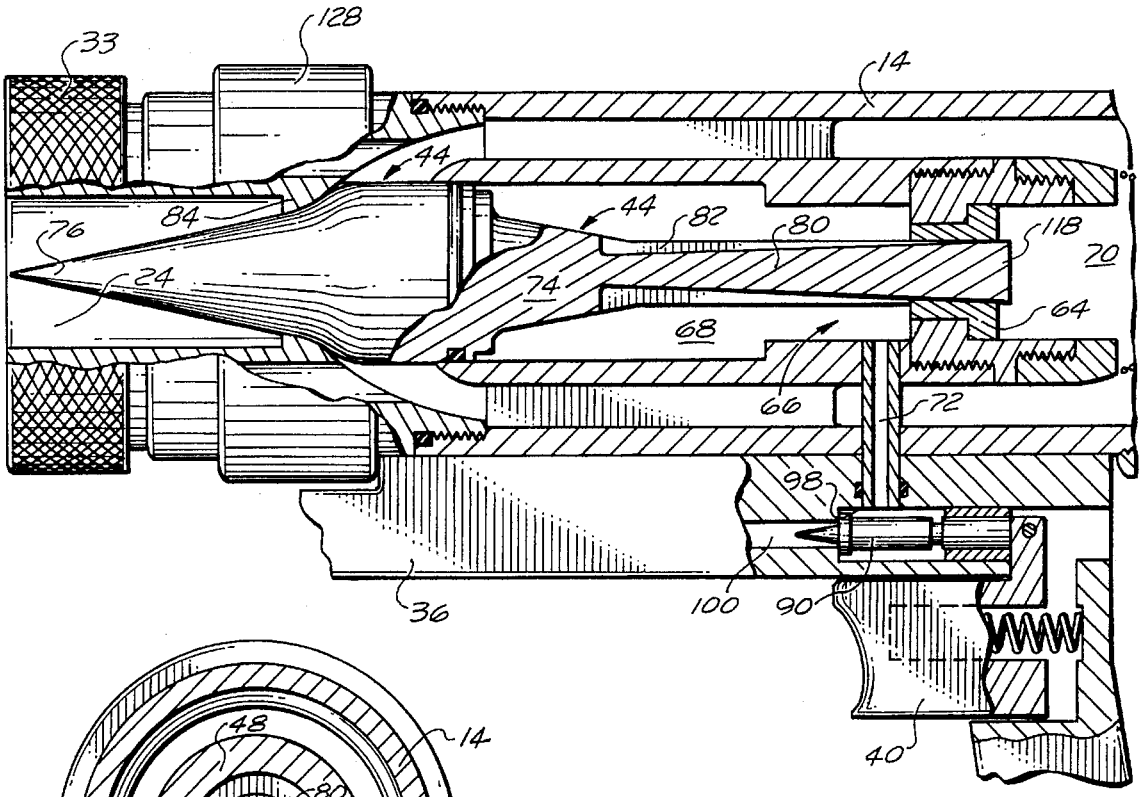
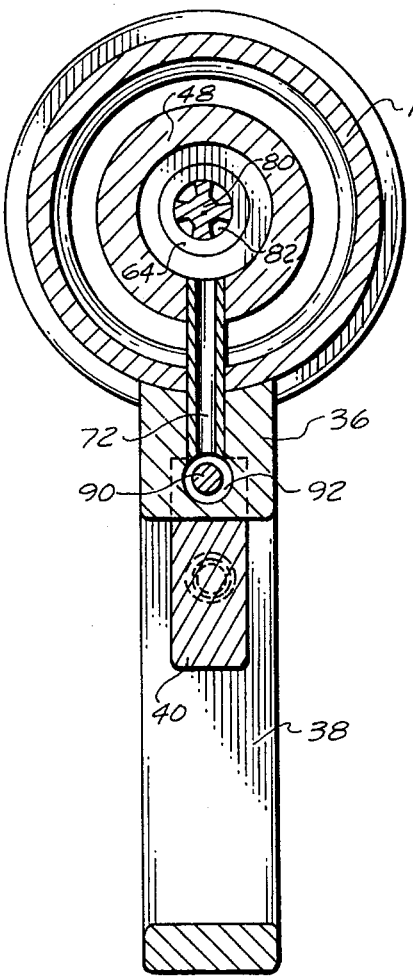
FIG. 7
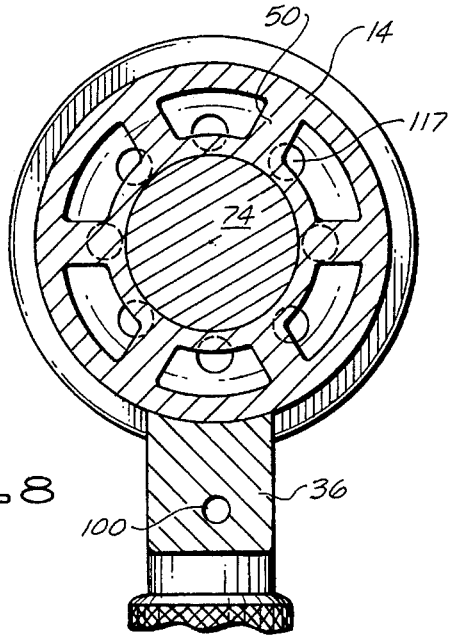
FIG. 8

306
308
310
312
314
316
318
320
322
60
48
44A
14
90
36
72
34
282
288
289
270
298
302
304
283B

FIG. 34
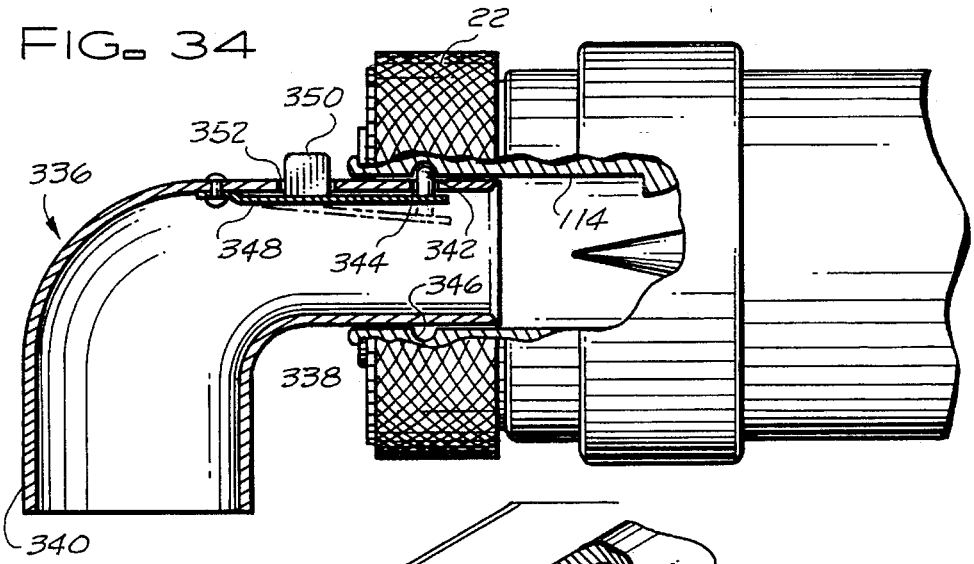
FIG. 35
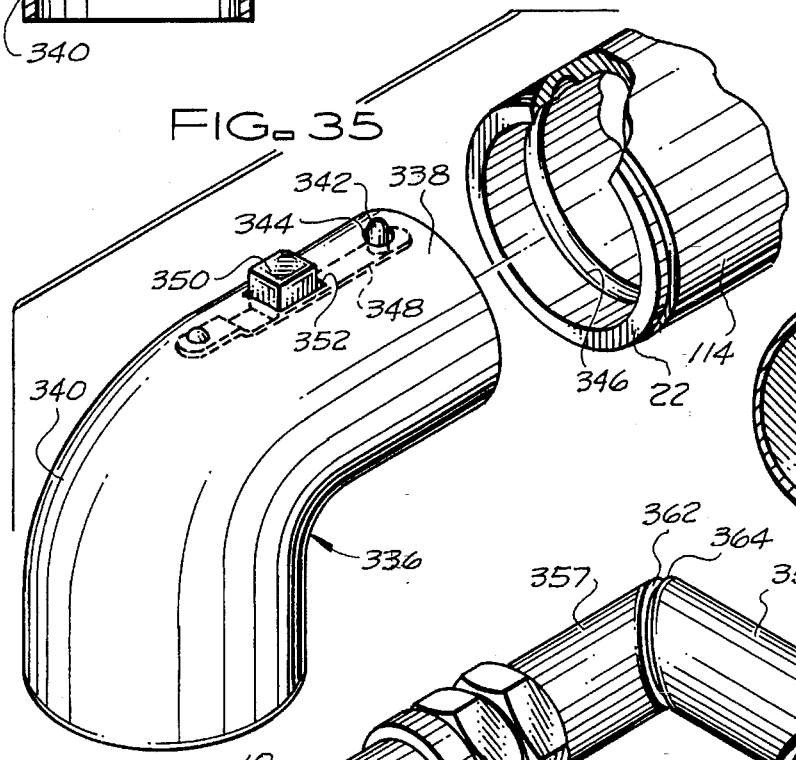
FIG. 39
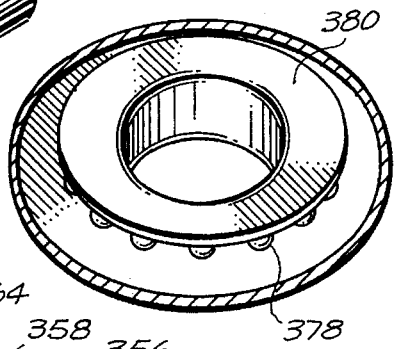
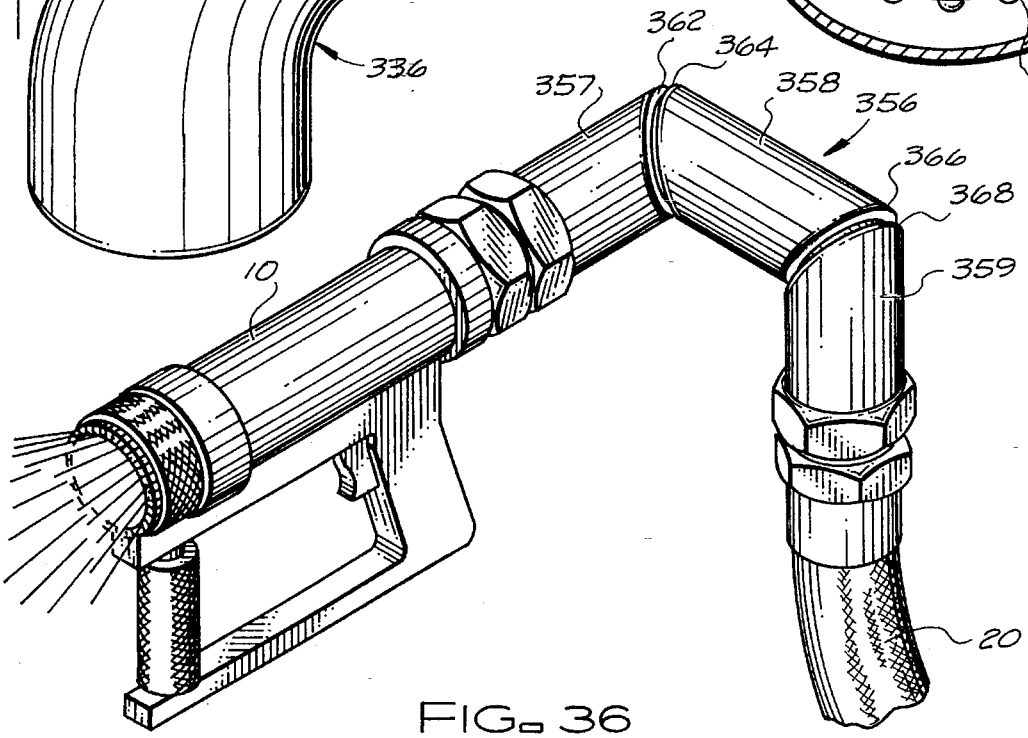
FIG. 36

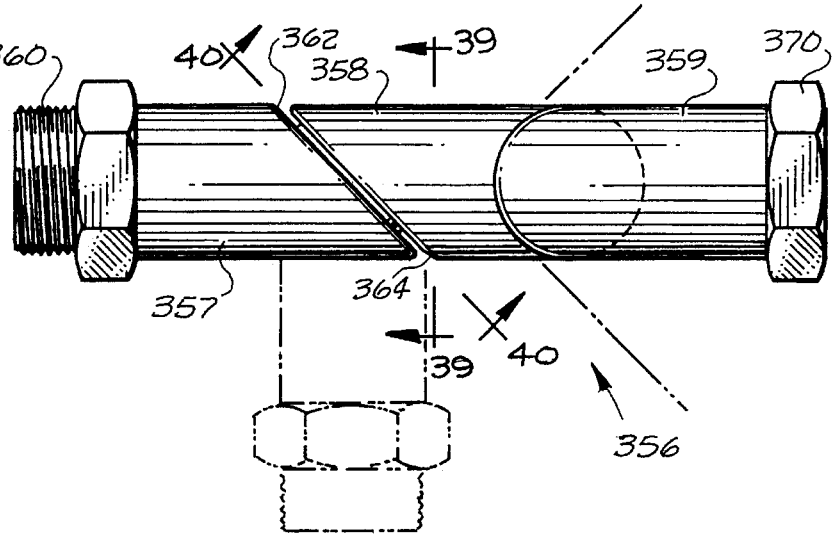
FIG. 37
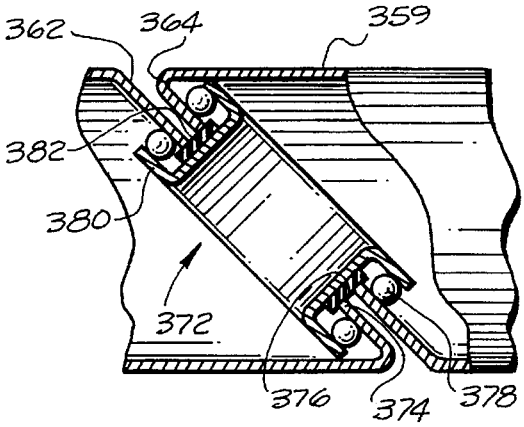
FIG. 38
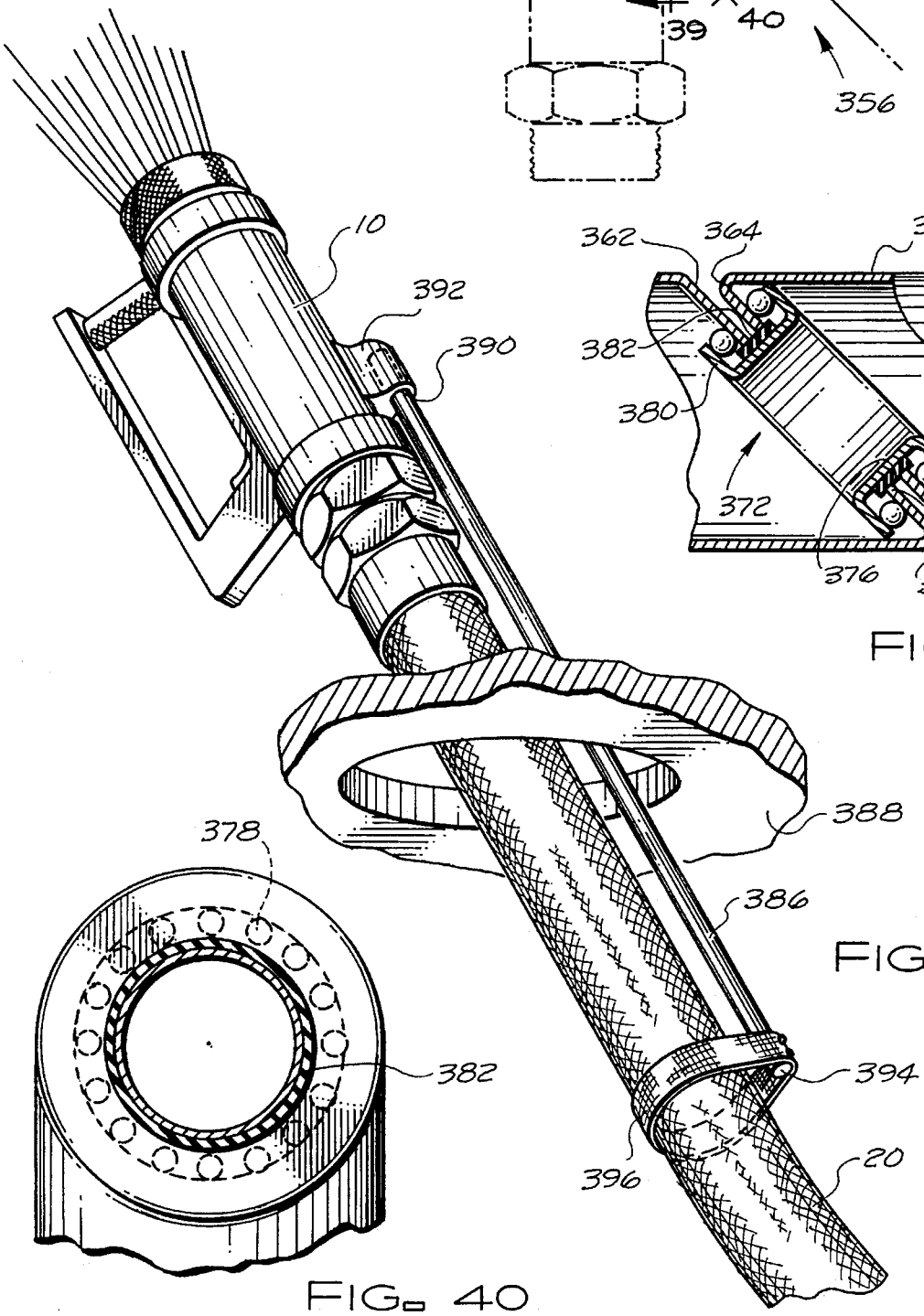
FIG. 41
FIG. 40

FIREFIGHTING NOZZLE WITH FOAM INJECTION SYSTEM

CROSS-REFERENCE TO RELATED APPLICATION

This application is a continuation-in-part of our earlier U.S. patent application, Ser. No. 050,974, filed Apr. 19, 1993, now U.S. Pat. No. 5,447,203, which was a continuation-in-part of Ser. No. 731,492, filed Jul. 17, 1991, now U.S. Pat. No. 5,261,494.

BACKGROUND OF THE INVENTION

1. Field Of the Invention

This invention relates to the art of firefighting equipment.

More particularly, this invention relates to a spray nozzle for attachment to a fire hose.

In a further and more specific aspect, the instant invention concerns a firefighting nozzle capable of discharging a variable solid stream and a variable fog spray, with controls for each type of spray being operable independently of and simultaneously with one another.

DESCRIPTION OF THE PRIOR ART

Firefighting nozzles can be broadly classified into two basic types. The oldest and simplest type of nozzle, known as the solid stream or straight tip nozzle, consists essentially of a tapered cone secured to the end of a fire hose, with a quarter-turn ball valve or similar device incorporated into the nozzle opening for controlling the flow of water. A more modern type of nozzle, known as an automatic nozzle, incorporates a spring-biased disc into the discharge opening for maintaining a substantially constant pressure in the nozzle. Each of the foregoing nozzles has its own advantages and disadvantages which makes it more suitable for certain applications than for others.

The primary advantage of the solid stream nozzle, for instance, is that it concentrates the water from the fire hose into a high force, high velocity, circular stream which is extremely effective in "punching through" fires and burning debris to extinguish flames. A drawback of this type of nozzle, however, is that a very high reaction force is generated by the flow when the control valve is fully opened, making the nozzle difficult and sometimes unsafe for a fireman to handle. The reaction force can be decreased by partially closing the control valve, but this creates severe turbulence in the nozzle, which causes the quality of the stream to deteriorate, and reduces the reach of the stream.

Still another problem encountered with the solid stream nozzles is that tips of various exit orifice diameters must be attached to the nozzle, depending on the available water pressure, water volume, and the number of firefighters available to handle the hose. The necessity to change tips is inconvenient and can cause dangerous delays in responding to a fire.

As a result of the above drawbacks of solid stream nozzles, the automatic nozzle has become more widely used in the United States. One key advantage of the automatic nozzle is that the constant pressure feature allows for a constant reach of the water stream regardless of pressure oscillations at the source. In addition, the automatic nozzle easily incorporates a feature known as "fog generation", which allows the nozzle to emit a conical spray of evenly distributed water droplets. This is done by forming a number of inwardly and forwardly projecting rods or teeth along the inner circumference of the discharge orifice. These teeth cause the water to variably change direction and to be emitted in all directions of the included solid angle of a cone. The resultant fog is highly desirable, since it spreads over a relative wide area, forming a protective shroud cooling the flames in the immediate vicinity of the firefighter. The advantages of this type of nozzle are somewhat diminished, however, by its inability to produce the same type of highly concentrated, forceful stream which is available in a solid stream nozzle for punching through burning debris.

A third type of nozzle, known as the Navy nozzle, consists of a straight tip nozzle and a fog-generating nozzle, provided one above the other. A diverter valve allows the operator to choose which nozzle to use. Even this arrangement is not entirely satisfactory, however, since only one option is available at a time, and the choice of which type of stream to use in a given situation is not always a clear-cut or easy one.

In addition to the problem of how to provide both fog-generating and solid stream capabilities in a single nozzle, another question facing nozzle designers is how to introduce foam firefighting agents into the water when circumstances require. Most firefighting systems induce foam by injecting foam concentrate into either the suction side or the discharge of the fire pump. Other systems induce foam in the hose line through an in-line Venturi, sucking fluid from 5-gallon pails. Still other systems induce foam at the nozzle using the "DDT sprayer" principle which involves blowing air across a vertical tube leading from the foam receptacle to create a low pressure region, thereby sucking foam out of the receptacle by the Bernoulli effect, and then atomizing and spraying the foam. Each of these systems suffer from various problems including limited pressure range and line blockage.

Other challenges faced by nozzle and hose designers are how to provide the capability for spraying in hard-to-reach locations, such as around corners and through false ceilings, and to how to relieve the firefighter from the high reaction forces exerted by the spray.

It would be highly advantageous, therefore, to remedy the foregoing and other deficiencies inherent in the prior art.

OBJECTS OF THE INVENTION

Accordingly, it is an object of the present invention to provide a firefighting nozzle capable of producing a solid stream and a fog spray simultaneously.

Another object of the invention is the provision of a nozzle having two orifices for producing different types of spray, and independently operable valves for controlling the flow through each orifice.

And another object of the invention is the provision of a variety of different arrangements for remotely controlling a firefighting nozzle.

And another object of the invention is to provide various means of inducing foam in a firefighting nozzle.

And still another object of the invention is the provision of means enabling a firefighter to spray water around corners.

Yet another object of the invention is to provide means for attaching a firefighting nozzle to a ladder or windowsill or the like to relieve a firefighter from reaction forces.

A still further object of the invention is the provision of a stiffening rod enabling a hose to be raised to inaccessible positions.

And yet still a further object of the invention is to provide a firefighting nozzle, according to the foregoing, which is relatively inexpensive to manufacture and comparatively simple and easy to use.

SUMMARY OF THE INVENTION

Briefly, to achieve the desired objects of the instant invention in accordance with the preferred embodiment thereof, a firefighting nozzle is provided with independently variable solid stream and fog spray capability. The nozzle comprises a hollow body having a centrally formed jet orifice at its outlet end. A annular fog spray opening concentrically surrounds the jet orifice. A jet control valve is provided in the jet orifice for allowing selective variation of the diameter of the solid stream discharged from the orifice. A fog control valve is provided in the fog spray opening for selectively varying the intensity of the flow through the opening. In addition, a shaper ring is provided for selectively varying the included angle of the fog cone.

In a preferred embodiment of the invention, the jet control valve consists of a valve body mounted for longitudinal movement toward and away from a valve seat provided near the outlet end of the nozzle. The rear portion of the valve body extends into a hydraulic chamber having an inlet and an outlet. A needle valve controls flow through the outlet of the hydraulic chamber, thus controlling the amount of pressure exerted on the valve body. The needle valve is actuated by a manually controlled trigger movably connected to a rear grip depending from the nozzle body. The distance from the jet valve body to the valve seat, and thus the diameter of the discharged solid stream and the resulting reaction force, is dependent on the force exerted on the trigger.

The fog control valve comprises an annular valve body mounted for reciprocation toward a valve seat defining the inner circumference of the annular fog spray opening. The rear portion of this valve body also extends into a hydraulic chamber having an inlet and an outlet. The outlet is controlled by a twist-actuated metering valve mounted in a front grip depending from the nozzle body. The fog valve is opened an amount proportional to the amount of twist on the metering valve. The metering valve retains its position even if the nozzle is dropped, so that a protective spray is always available for protecting the firefighters. In addition, for safety reasons, the shaper ring is mounted such that it returns to its widest spray position when its control lever is released, so that reaction forces are minimal.

In other embodiments, the manually actuated needle valve for controlling the jet control valve and the twist-actuated metering valve for controlling the fog control valve are replaced by remote actuators.

In still other embodiments, various means are provided for inducing foam concentrate down the centerline of the jet control valve.

Various attachments are provided for the nozzle and hose for allowing a firefighter to spray in hard-to-reach locations, and for relieving the reaction forces of the spray.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 6 is a view similar to FIG. 5, with the jet control valve fully closed;

FIG. 7 is a cross-sectional view taken through line 7—7 of FIG. 5;

FIG. 8 is a cross-sectional view taken through line 8—8 of FIG. 5;

FIG. 34 is a fragmentary perspective view of the attachment shown in FIG. 33, with portions broken away for clarity;

FIG. 35 is an exploded perspective view showing the nozzle and attachment of FIGS. 33 and 34;

FIG. 36 is a perspective view of an embodiment of the invention incorporating an attachment for allowing the nozzle and hose to bend around corners;

FIG. 37 is a side view showing the attachment of FIG. 36;

FIG. 38 is a fragmentary sectional view of the attachment of FIG. 36;

FIG. 39 is a perspective view of the section designated by line 39—39 of FIG. 37;

FIG. 40 is a sectional view taken through line 40—40 of FIG. 37; and FIG. 41 is a perspective view showing an alternate embodiment of the invention incorporating a stiffening rod for allowing the nozzle and hose to be lifted to inaccessible locations.

DETAILED DESCRIPTION OF THE PREFERRED EMBODIMENTS

Figure 1:
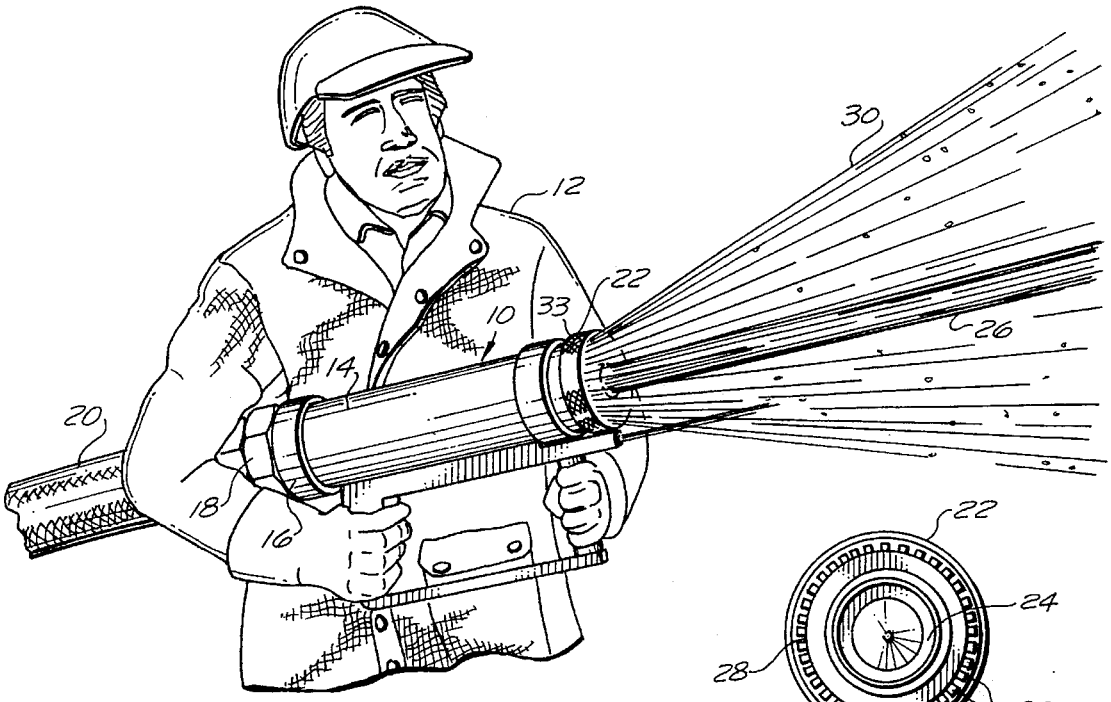
FIG. 1 is a perspective view showing a firefighter operating a nozzle according to the instant invention.
Figure 3:
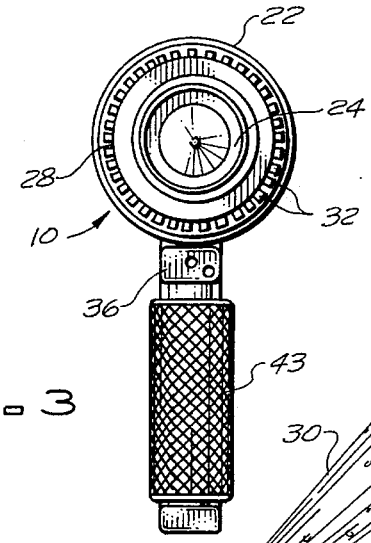
FIG. 3 is a front view of the nozzle.
Figure 2:
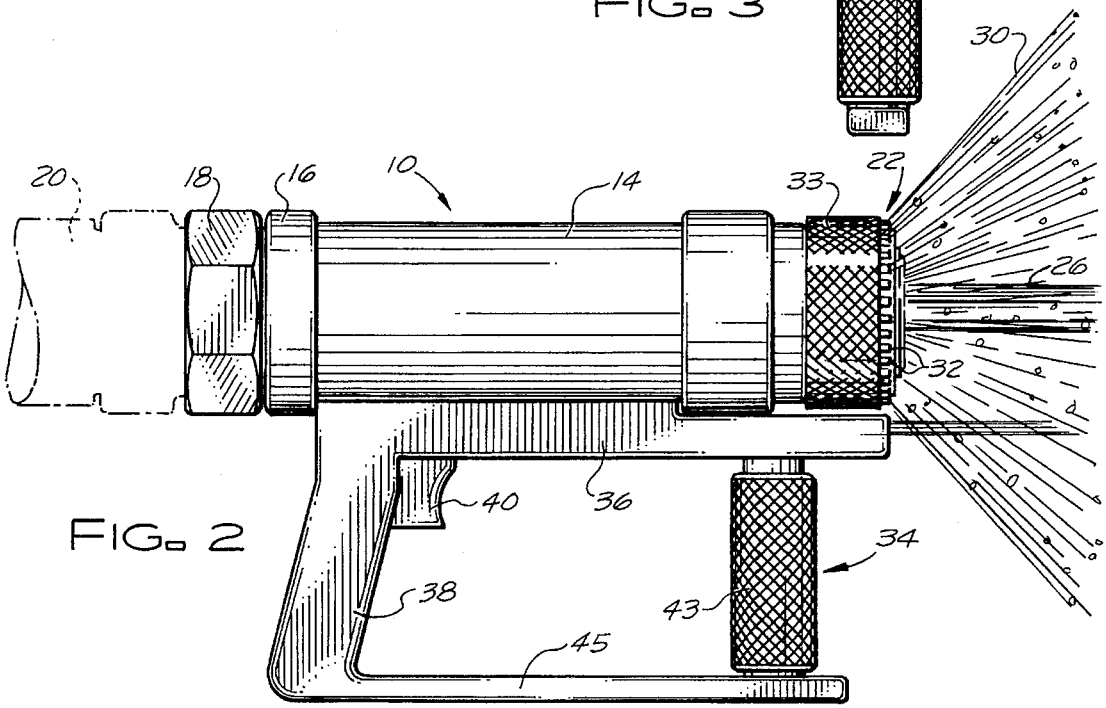
FIG. 2 is a side view showing the nozzle of FIG. 1.

Turning now to the drawings in which like reference characters indicate corresponding elements throughout the several views, attention is first directed to FIG. 1, which shows the nozzle according to the present invention, indicated in its entirety by the numeral 10, being manipulated by a firefighter 12. With further reference to FIGS. 2 and 3, the nozzle 10 comprises a generally cylindrical nozzle body or outer housing 14 having an inlet end 16 secured by a swivel coupling 18 to a conventional fire hose 20. The outlet end 22 of the nozzle body 14 defines a central jet orifice 24 for discharging a circular, solid stream 26 of liquid. The jet orifice 24 is concentrically surrounded by an annular fog spray opening 28 for discharging a conical spray or fog 30, made up of liquid droplets which are evenly distributed throughout the cone. The droplets are produced by a plurality of inwardly curved, forwardly projecting teeth 32 formed along the circumference of the fog spray opening 28. A shaper ring 33 is moveably mounted at the outlet end 22 of the nozzle body 14, for allowing adjustment of the included angle of the fog cone 30.

A specially configured gripping assembly 34 is provided on the underside of the nozzle body 14. The gripping assembly 34 includes an upper support bar 36, a rear pistol grip 38 having a manually actuable trigger 40, and a front grip 42 having a twist actuator 43 with a knurled outer surface. A lower guard bar 45 extends between rear grip 38 and front grip 42, preventing the hose 20 or other object from becoming entangled in the gripping assembly and accidentally depressing the trigger 40. The function and structure of trigger 40 and twist actuator 43 will be described shortly.

Figure 4:
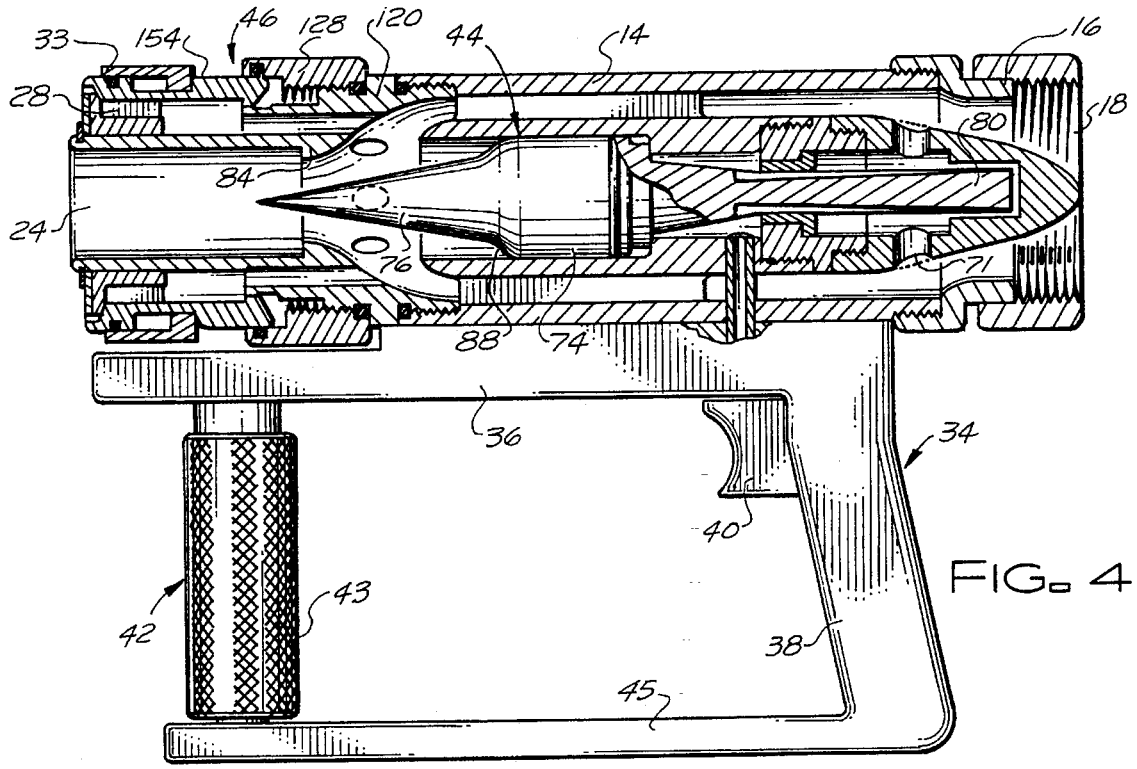
FIG. 4 is a longitudinal sectional view of the nozzle, with details of the handle and controls eliminated for purposes of clarity.

Turning now to FIG. 4, a jet control valve 44 is provided for controlling the discharge of liquid through the jet orifice 24. Specifically, the jet control valve 44 allows the diameter of the circular solid stream 26 to be selectively varied. In addition, a fog control valve 46 is provided for controlling the discharge of liquid through the annular fog spray opening 28. The jet control valve 44 and fog control valve 46 are operable both simultaneously with and independently of one another.

The structure and operation of the jet control valve 44 can be best understood by referring to FIGS. 5–9. As can be seen most clearly in FIG. 9, the jet control valve 44 includes an interior valve housing 48, which is located in spaced relationship to the inner sidewall of the outer housing 14 by a plurality of radially extending straightening vanes 50. For ease of manufacturing, the interior valve housing 48 is preferably constructed as a three-piece body, including a generally tubular front member 52 having an open front end 54 and an internally threaded, open back end 56; a rear member 57 having an internally threaded open, front end 58 and a closed back end 60; and a generally tubular, central connector member 62 having both ends externally threaded for cooperation with the corresponding internally threaded ends of the front and rear members 56, 57. A sleeve bearing 64 is carried in the bore of the connector member 62.

Figure 5:
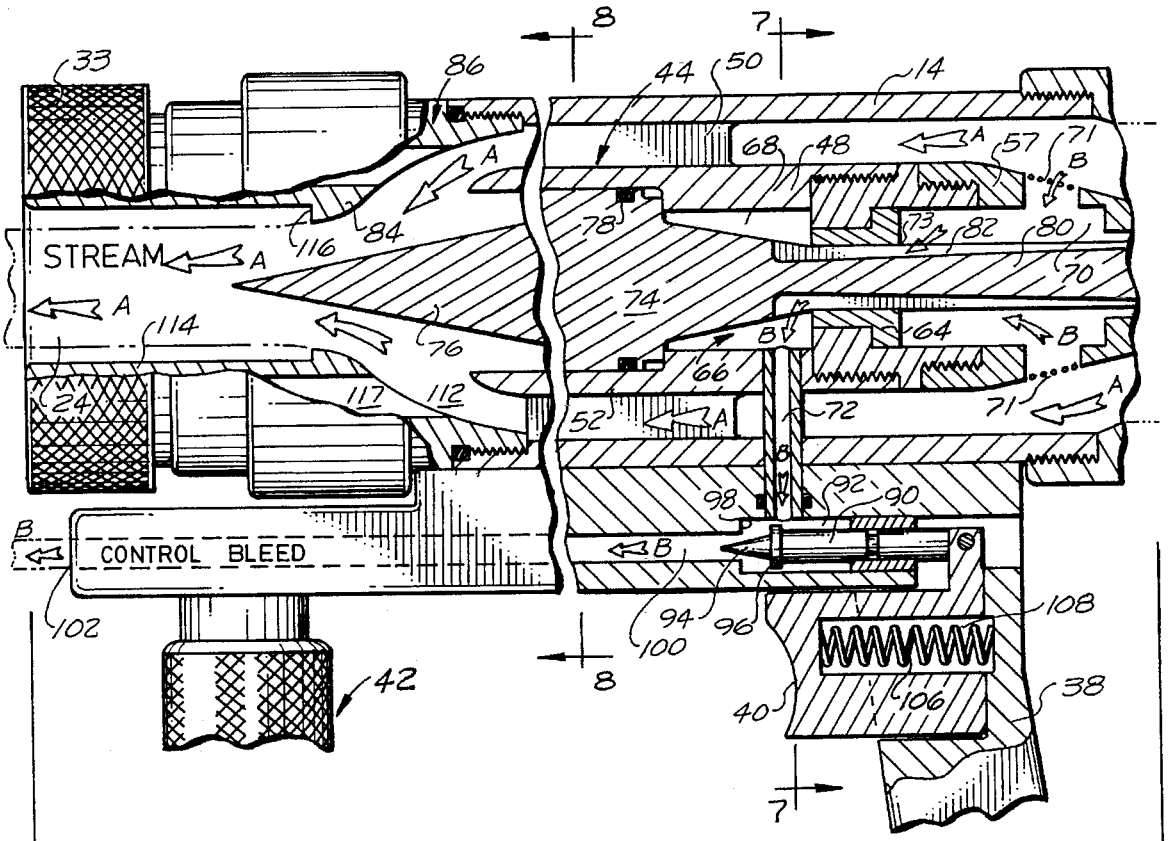
FIG. 5 is an enlarged fragmentary sectional view showing the rear portion of the nozzle, with the jet control valve fully opened.
Figure 9:
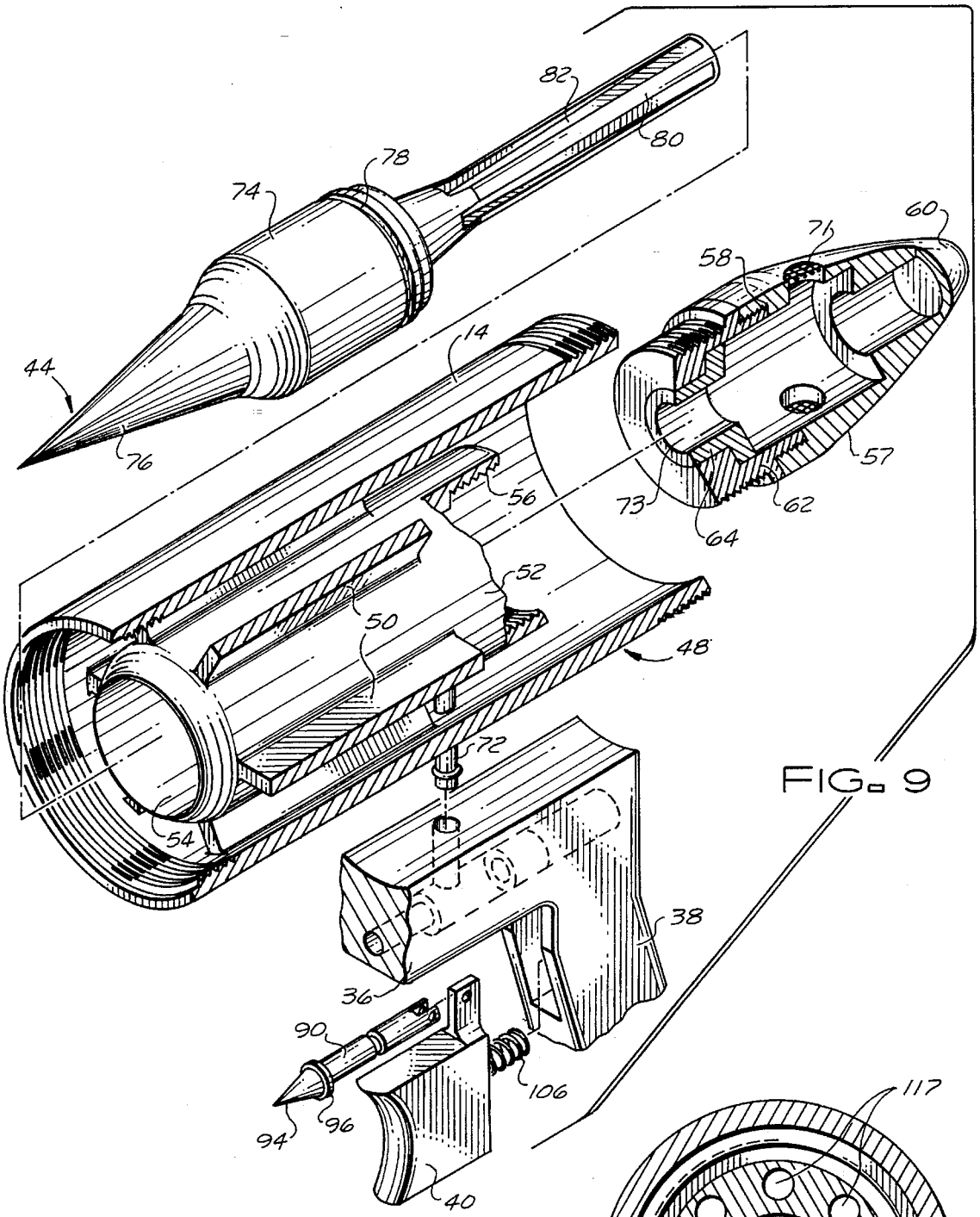
FIG. 9 is an exploded perspective view, partially in section, showing the components of the jet control valve and its associated controls.
Figure 13:
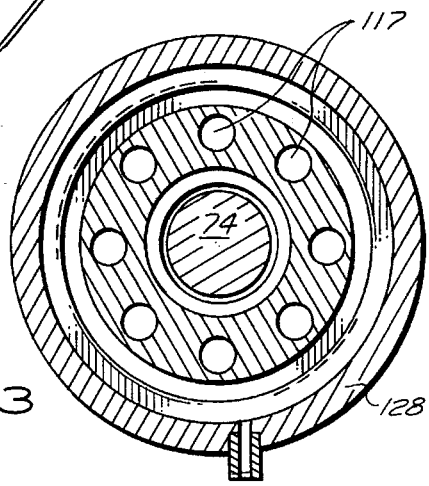
FIG. 13 is a cross-sectional view taken through line 13—13 of FIG. 10.

With additional reference to FIG. 5, the interior valve housing 48 defines a hydraulic chamber 66, consisting of a front chamber 68 carried in the front member 52 and a rear chamber 70 carried in the rear member 57. A plurality of circumferentially spaced apart, meshed covered openings 71 formed in the sidewall of the rear chamber 70 serve as inlets for admitting filtered liquid into the rear chamber 70. An outlet passage 72 extending through the sidewall of the front member 52 discharges liquid from the front chamber 68. The bore 73 of the sleeve bearing 64 defines a flow passage connecting the two chambers 68, 70.

A valve body 74 having a forwardly tapered front end 76 is mounted for longitudinal translation within the hydraulic chamber 66. A sealing ring 78 carried on an intermediate portion of the valve body 74 prevents liquid in the hydraulic chamber 66 from escaping past the front end 76. In addition, the valve body 74 includes an elongated tail portion 80 which extends rearwardly through the sleeve bearing 64. A plurality of longitudinally extending grooves 82 are machined or otherwise formed in the tail portion 80. The depth of the grooves 82 increases toward the front of tail portion 80.

An annular valve seat 84 is formed forwardly of the valve body 74. The valve seat 84 is formed along the rear inner surface of a specially configured tip assembly 86, which will be described in greater detail shortly, in connection with the fog control valve 46. The surface of the valve seat 84 is preferably tapered or contoured to match the taper or contour of the base portion 88 of the conical front end 76 of the valve body 74, so that a tight seal is formed when the valve body 74 is in its full forward position, as shown in FIG. 6.

The movement of the valve body 74 relative to the valve seat 84 is controlled by varying the pressure in the front chamber 68 of the hydraulic chamber 66. This pressure is controlled by a needle-type metering valve 90, which is mounted for longitudinal reciprocation in a control passage 92 communicating with the outlet passage 72 from the front chamber 66. The control passage 92 comprises a chamber formed in the upper support bar 36 of the nozzle grip assembly 34, extending perpendicular to the outlet passage 72.

The needle valve 90 includes a suitably shaped front end 94, the base 96 of which resides against an annular valve seat 98 at the forward end of the control passage 92, when the valve 90 is in its fully forward position. As the valve 90 moves back, away from the valve seat 98, liquid in the control passage 92 is allowed to escape past the front end 94 of the needle valve 90, into a relief duct 100 extending longitudinally through the support bar 36. Liquid in the relief duct 100 exits as a forwardly directed stream through an outlet 102 formed in the front end of the support bar 36.

The needle valve 90 is mechanically coupled to the trigger 40 moveably mounted in the rear grip 38. The trigger 40 is biased to a full forward position by a spring 106 having one end secured to the grip 38 and another end carried in a cavity 108 formed in the trigger 40. Thus, the trigger automatically returns to the forward position when released, forcing the needle valve 90 against the valve seat 98, and shutting off the flow from the jet stream orifice 24. This is an important safety feature, since the high reaction forces generated by the jet stream could cause the hose 20 to whip around dangerously, injuring firefighters, if the jet stream valve 44 were to remain open if the nozzle 10 was dropped.

FIG. 5 illustrates the flow of liquid through the nozzle 10 when the trigger 40 is in its completely retracted position, fully opening needle valve 90 and jet control valve 44. Pressurized liquid enters through the inlet end 16 of the nozzle 10 and flows around the interior valve housing 48 and past the straightening vanes 50, as indicated by arrows A. The liquid then enters the tip assembly 86 through a smooth-walled flow passage 112 which continuously diminishes in area in the forward direction, slowly accelerating the flow to produce a more stable liquid jet. From the flow passages 112, some of the liquid enters an outlet tube 114. The flow passages 112 form a sharp corner 116 with the outlet tube 114, allowing the liquid to make a "clean break". Any liquid not entering the outlet tube 114 flows into the fog spray opening 28 via a plurality of circumferentially spaced apart openings 117 formed in the wall of the flow passage 112, as will be described shortly.

In addition to the liquid flowing around the interior housing 48, a small amount of liquid enters the hydraulic chamber 66 through openings 71 in the rear member 57, as shown by Arrows B. The liquid travels from rear chamber 70 to the front chamber 68 via the grooves 82 in the tail portion 80 of the valve body 74, which allow maximum flow through the sleeve bearing 64 when the valve body 74 is fully aft. From the front chamber 68, the liquid enters the outlet passage 72, passes around the front end 94 of the shaped needle valve 90 into the relief duct 100, finally exiting through the outlet 102. Because of the continuous discharge of liquid through the outlet passage 72 and relief duct 102, the pressure in the hydraulic chamber 66 is always minimum, allowing the jet control valve body 74 to remain fully aft until the trigger 40 is released.

FIG. 6 illustrates the valve configuration when the trigger 40 is released, closing the needle valve 90 and the jet control valve 44. In this configuration, the needle valve 90 resides against the valve seat 98, shutting off the flow from the outlet passage 72 to the relief duct 100. As a result, the pressure in the front chamber 68 of the hydraulic chamber increases, forcing the valve body 74 forwardly until the base portion of the tapered front end 76 sealingly engages the valve seat 84, cutting off flow to the outlet tube 114. In addition, when the valve body 74 is in its fully forward position, the rear end 118 of the tail 80 allows minimum leakage into the hydraulic chamber, maintaining the valve body 74 in its forward position.

Although not specifically illustrated, it will be clear to the skilled practitioner that the trigger 40 may be held in any position intermediate the two extremes shown in FIGS. 5 and 6. As the trigger 40 is retracted, the valve body 74 moves away from the valve seat 84 by an amount proportional to the pull on the trigger, thus increasing the area between the front end 76 of the valve and the valve seat 84, resulting In a jet of greater diameter. Since the reaction force generated by the stream varies in proportion to its size for a given pressure, the nozzle operator is able to simply and quickly adjust this force to its safest, most effective level merely by varying the pull on the trigger 40.

Figure 10:
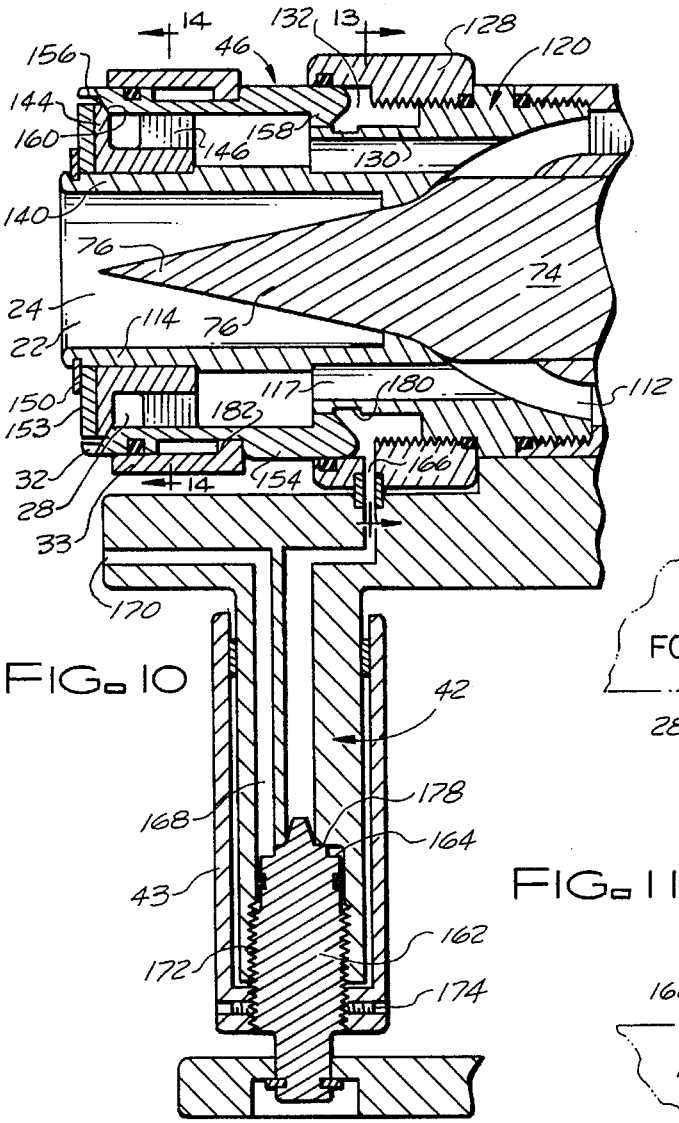
FIG. 10 is a an enlarged fragmentary longitudinal cross section, showing the front portion of the nozzle, with both the jet control valve and the fog control valve fully closed.
Figure 14:
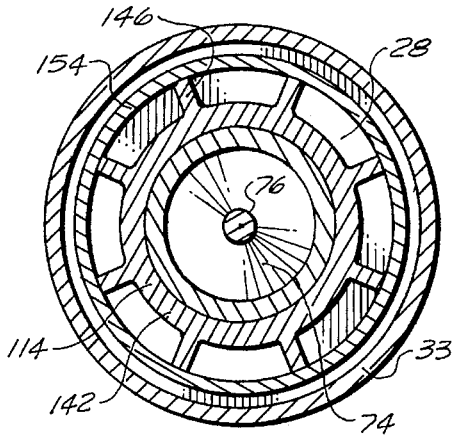
FIG. 14 is a cross-sectional view taken through line 14—14 of FIG. 10.
Figure 15:
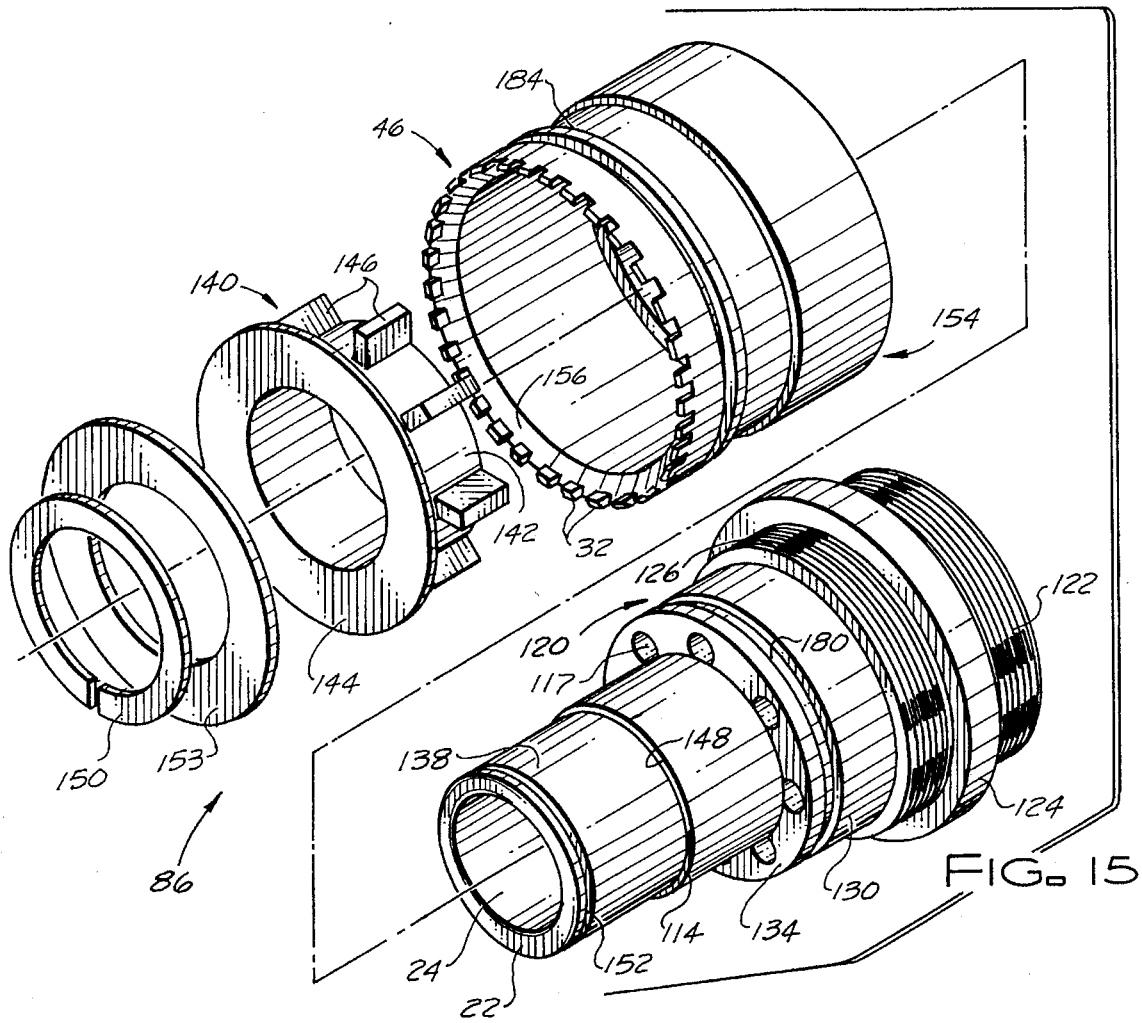
FIG. 15 is an exploded perspective view showing the front portion of the nozzle body and the fog control valve, with the housing nut and shaper ring omitted for purposes of clarity.

Flow downstream of the jet control valve 44 may be best understood by referring to FIG. 15, which shows the components of the tip assembly 86, and also to the longitudinal cross sections in FIGS. 4 and 10. The tip assembly 86 includes a generally cylindrical main body 120 having an externally threaded rear end 122 for attachment to the front end of the nozzle body 14. A radially extending flange 124 separates threaded end 122 from a second externally threaded portion 126, on which an internally threaded housing nut 128 is mounted. The outer diameter of the main body 120 is reduced forwardly of the threaded portion 126 to form a boss 130. A hydraulic chamber 132 is defined between the boss 130 and the inner surface of the housing nut 128.

The outer diameter of the main body 120 is reduced still further forwardly of the boss 130, forming outlet tube 114. The front end of the boss 130 extends perpendicularly to the outlet tube 114, forming an annular end wall 134. A plurality of bores or openings 117 extend longitudinally from the annular end wall 134 to the rear inner surface of the main body 120, where they intersect with the flow passages 112 described earlier, in connection with FIG. 5.

The outer surface of the outlet tube 114 is stepped slightly inwardly at a location halfway between annular wall 134 and the outlet end 22 to form a reduced diameter front portion 138 on which a spacer ring 140 is mounted. The spacer ring 140 comprises an annular body 142 having a flange 144 extending radially outwardly from its forward end. A plurality of positioning vanes 146 extend radially outwardly from and longitudinally along the annular body 142. The spacer ring 140 is clamped against the step 148 in the outlet tube 114 by a split retaining ring 150 carried in a groove 152 formed at the outlet end 22 of the tube 114. An O-ring 153 is interposed between the spacer ring 140 and the retaining ring 150.

An annular valve body 154 is supported by the positioning vanes 146, and mounted for longitudinal movement along the outer surface of the outlet tube 114. The space between the valve body 154 and the outlet tube 114 defines the annular fog spray opening 28. The front end of the valve body 154 comprises a tapered surface 156 which terminates in forwardly projecting teeth 32. The rear end of the valve body 154 includes an inwardly projecting flange 158 which extends into the hydraulic chamber 132. When the valve body 154 is in fully forward position, as shown in FIG. 10, the bottom edge of the flange 158 engages the outer surface of the boss 130, minimizing flow between the fog spray opening 28 and the hydraulic chamber 132. At the same time, the tapered front surface 156 of the valve body engages the rear outer surface of the spacer ring 140, which functions as a valve seat 160. Together, the annular valve body 154 and the valve seat 160 are the primary components of the fog control valve 46.

Figure 21:
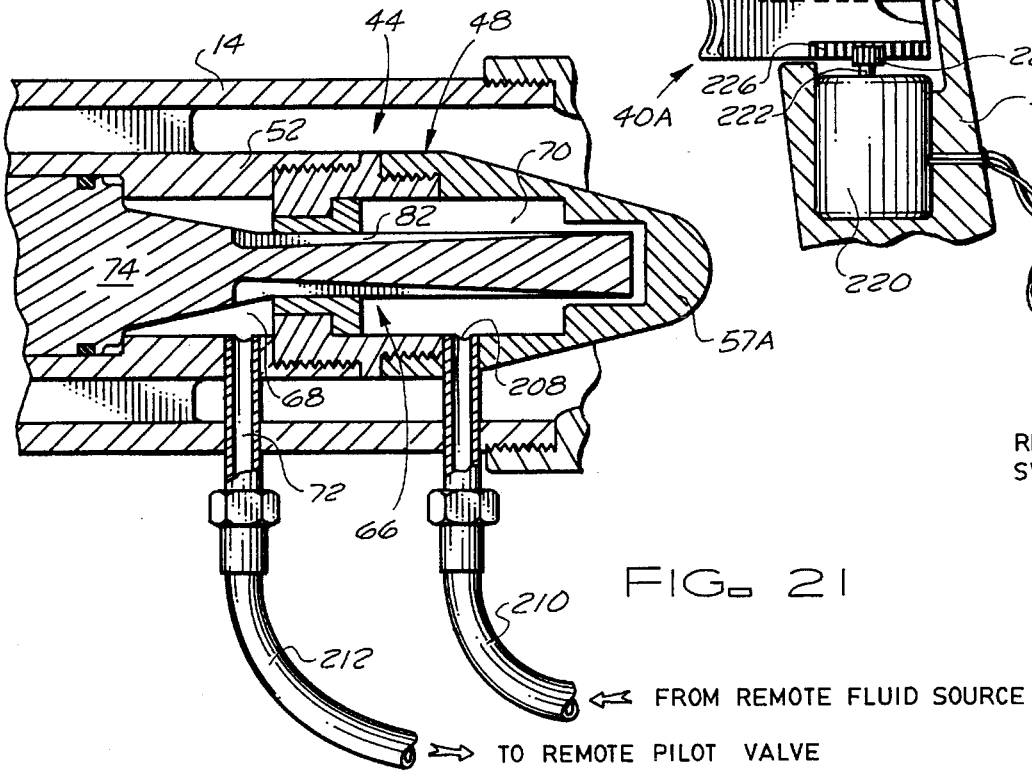
FIG. 21 is a fragmentary sectional view showing still another embodiment of the invention.
Figure 22:
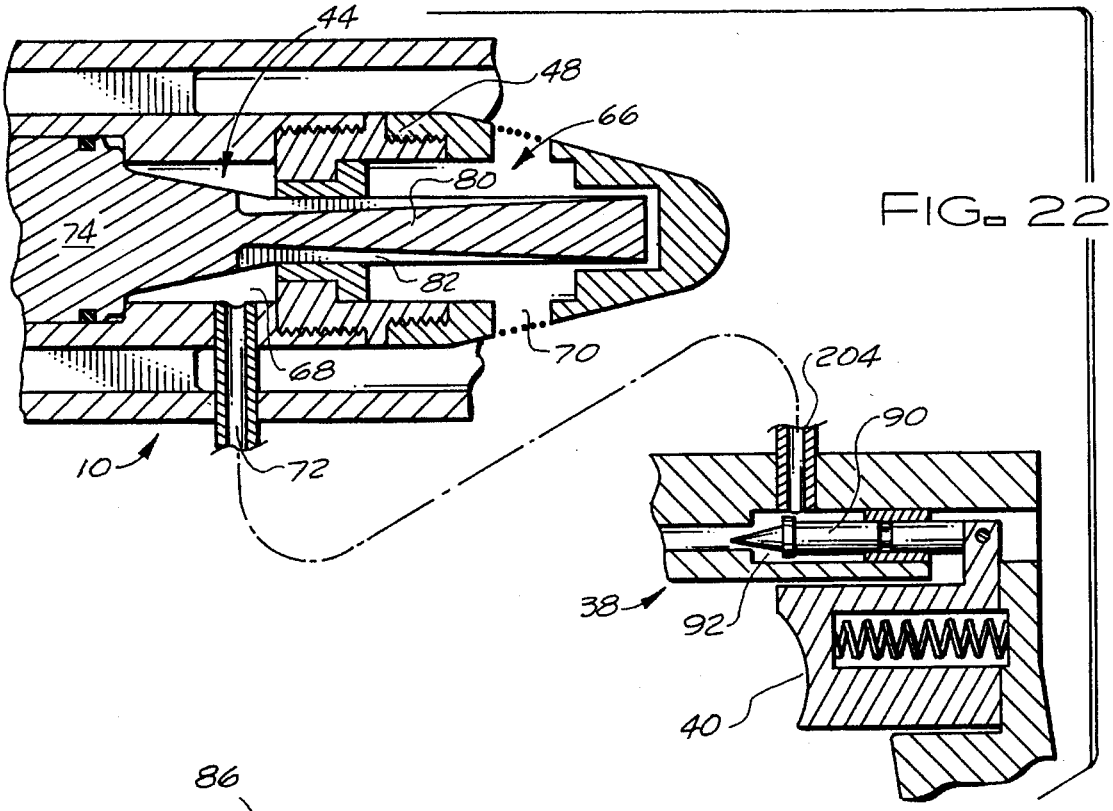
FIG. 22 is a fragmentary sectional view of the rear portion of the embodiment illustrated in FIG. 17.
Figure 23:
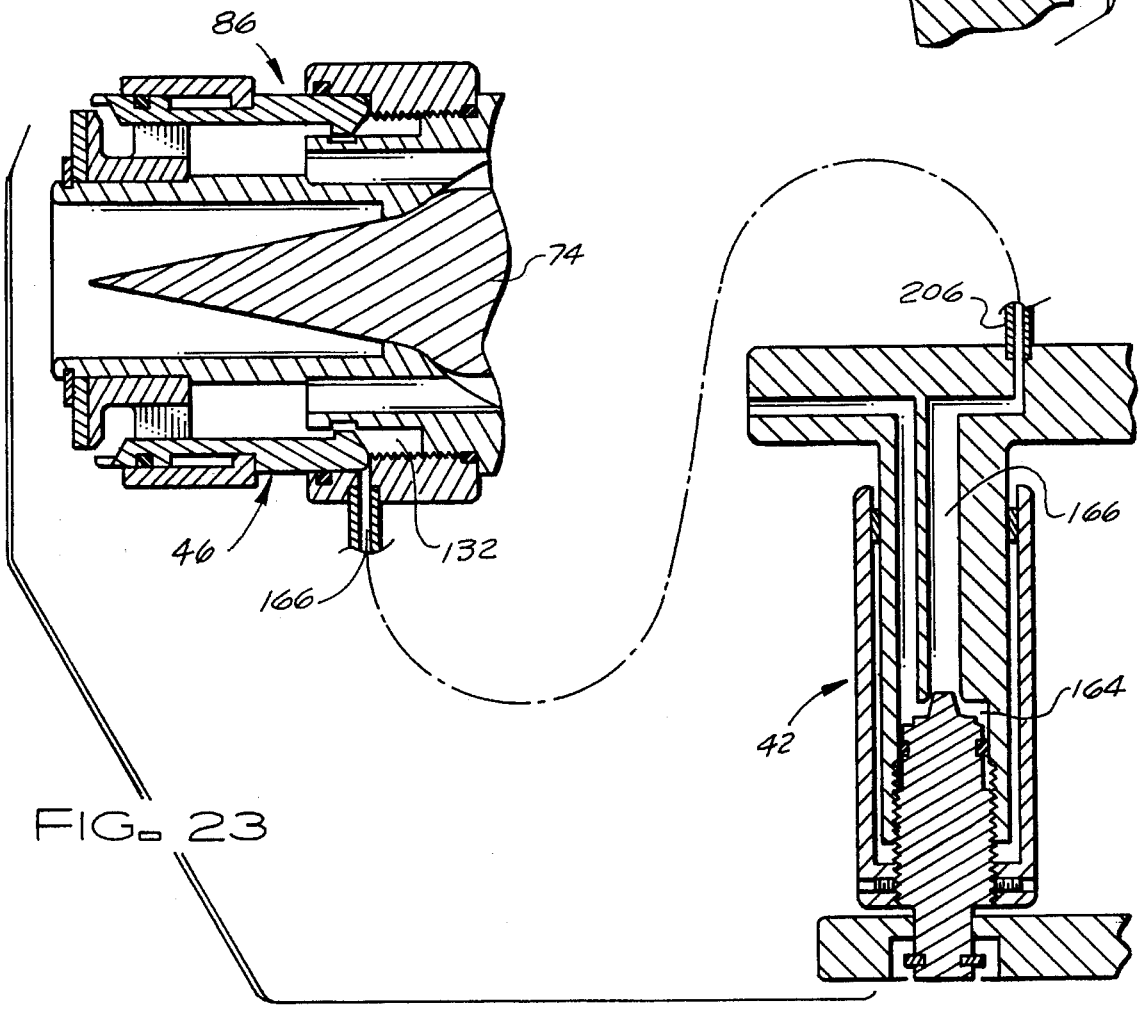
FIG. 23 is a fragmentary sectional view of the front portion of the embodiment illustrated in FIG. 17.

In the embodiment of FIGS. 22 and 23, as well as in the embodiment of FIGS. 1–15, the fluid used for actuating the valves 44 and 46 is the same as the liquid being dispensed from the hose—in most cases, water or a combination of water and firefighting foam. FIG. 21 shows an alternate embodiment, in which the jet control valve 44 is actuated either pneumatically or by a separate hydraulic fluid. In this embodiment, the jet control valve 44 includes a valve body 74 and an interior valve housing 48 including a front member 52 defining a front portion 68 of the hydraulic chamber 66 and a rear member 57A defining a rear portion 70 of the hydraulic chamber 66. The valve body 74, front member 52, and front portion 68 of the hydraulic chamber 66 are all identical to their counterparts in the embodiment of FIGS. 4–6. However, the rear member 57A of the interior valve housing 48 differs from the rear member 57 of the previous embodiment in that the openings 71 which admit fluid from the inlet end of the nozzle body 14 to the rear portion 70 of the hydraulic chamber 66 have been eliminated. Instead, the rear member 57A includes a single inlet port 208 which is coupled to a supply line 210 leading from a remote source of pressurized air or hydraulic fluid. The outlet passage 72 from the front portion 68 of the hydraulic chamber 70 is coupled to a return line 212 leading to a remotely located bleed valve, similar to the remote needle valve 90 of FIG. 22.

Operation of the jet control valve 44 in the embodiment of FIG. 21 is generally similar to that of the previous embodiments. That is, when the remote bleed valve is closed, the fluid pressure in the hydraulic chamber 66 is maximum, forcing the valve body 74 into its fully forward, or closed, position. When the bleed valve is opened, the pressure in the front portion 68 of the hydraulic chamber is reduced, allowing the valve body 74 to slide aft, thus opening the valve 44. As the valve body 74 moves back, the area of the grooves 82 on the tail portion 80 increases, allowing more fluid to enter the front portion 68 of the hydraulic chamber 66. Eventually, a state of equilibrium in which the rate of flow into the hydraulic chamber 66 balances the rate of flow through the bleed valve is reached, and the valve body 74 stops moving. Thus, the movement of the valve body 74 is proportional to the amount of pull on the trigger 40.

Because of the state of equilibrium which is reached in the embodiments of FIGS. 1–15, 21, and 22–23, wherein the rate of flow into the hydraulic chamber 66 equals the rate of flow out of the hydraulic chamber 66, each of these embodiments can be classified as a continuous bleed system. An alternate, non-continuous bleed system is illustrated in FIG. 18.

Figure 18:
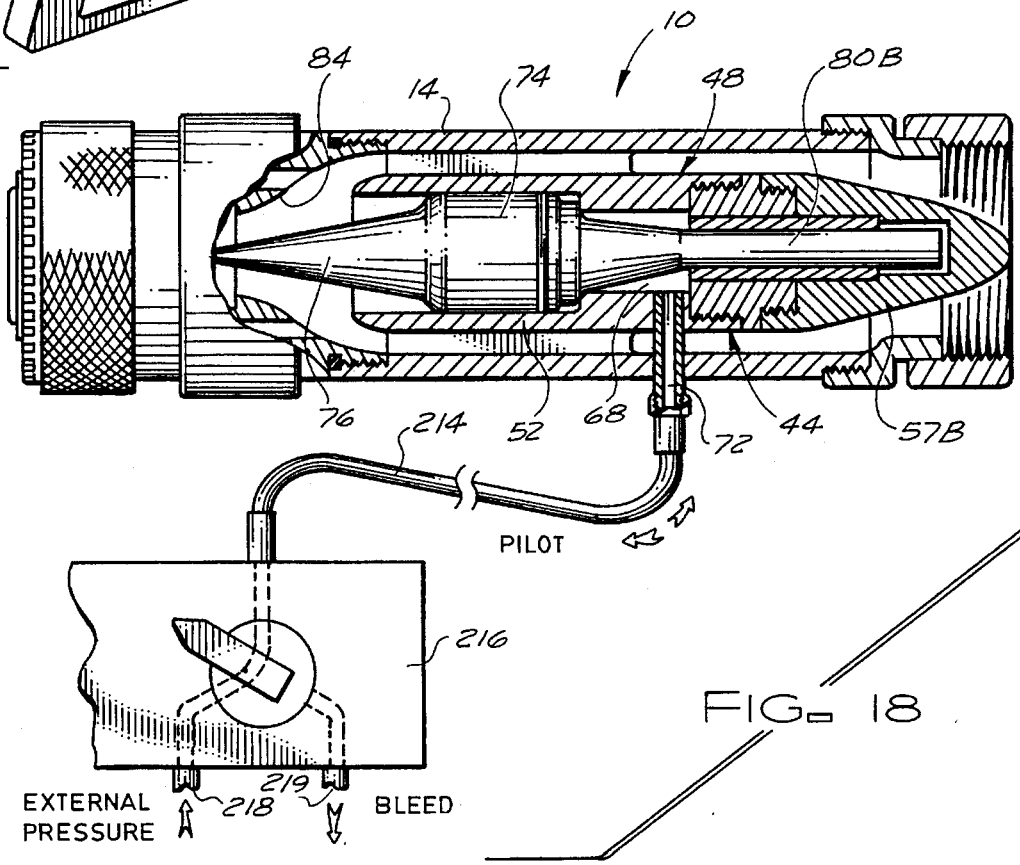
FIG. 18 is a perspective view, with a portion broken away, of another alternate embodiment of the invention.

As in the previous embodiments, the nozzle 10 of FIG. 18 includes a nozzle body or outer housing 14, an inner valve housing 48, and a valve body 74 disposed for reciprocation relative an annular valve seat 84. The front member 52 of the inner valve housing 48, as well as the front portion 76 of the valve body are exactly as described in connection with the earlier embodiments. However, the rear member 57B of the inner valve housing 48 differs from the rear member 57 of the earlier embodiments in that the rear portion 70 of the hydraulic chamber 66 and the meshed openings 71 have been eliminated. In addition, the grooves 82 have been eliminated from the tail portion 80B of the valve body 74. The outlet passage 72 from the front portion 68 (now the only portion) of the hydraulic chamber is coupled to a pilot line 214, which is coupled to a three-way valve 216. The three-way valve 216 is movable between a first position which couples the pilot line 214 to an external source 218 of pressurized fluid, a second position which couples the pilot line 214 to a bleed passage 219, and a third or "off" position which shuts off flow to and from the pilot line 214. When the valve 216 is in its first position, the pressurized fluid enters the hydraulic chamber 68, forcing the valve body 74 toward the valve seat 84 to close the jet control valve 44. When the valve 216 is in its second position, the fluid leaves the hydraulic chamber 68, causing the pressure in the chamber 68 to drop and the valve body 74 to move aft, opening the jet control valve 44. When the valve 216 is in its third position, the valve body 74 stops moving and the jet control valve 44 stays in its current state.

Figure 17:
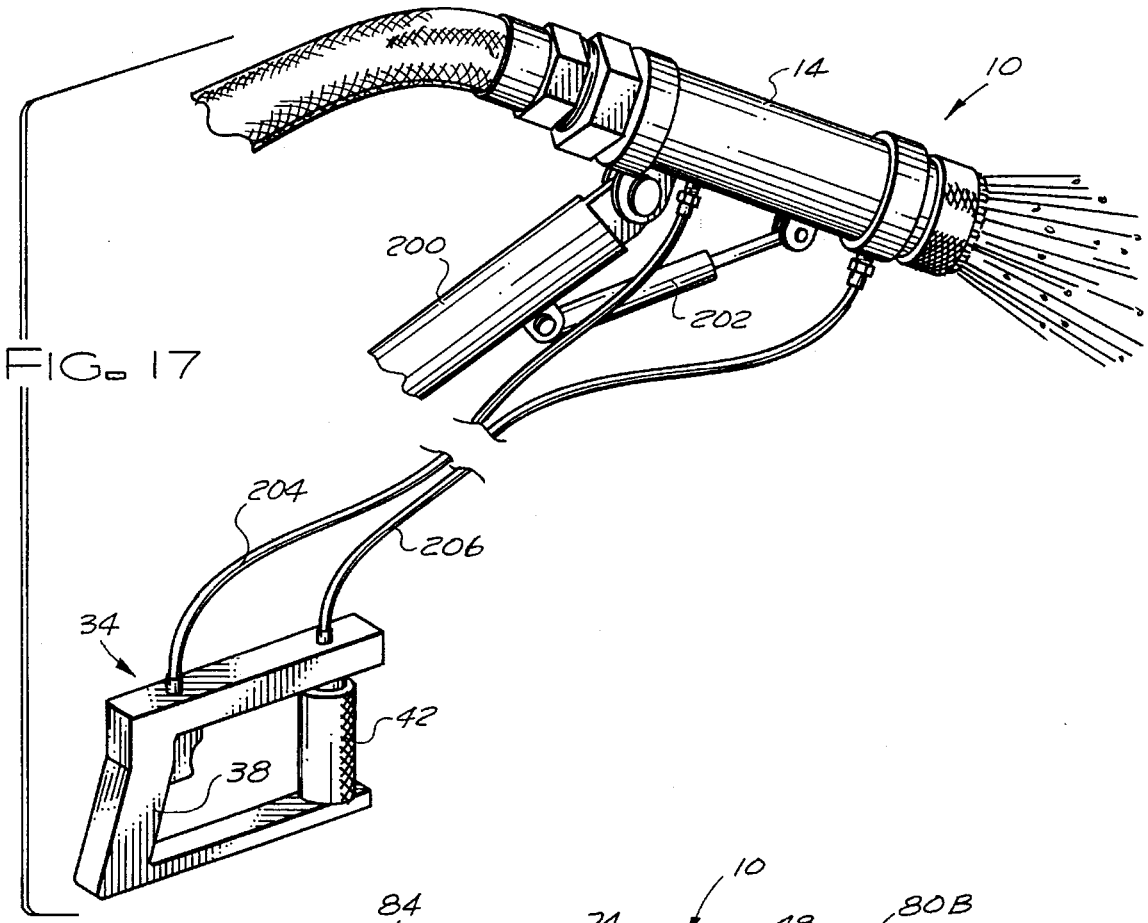
FIG. 17 is a perspective view showing an arrangement for remotely actuating a nozzle according to an alternate embodiment of the invention.
Figure 20:
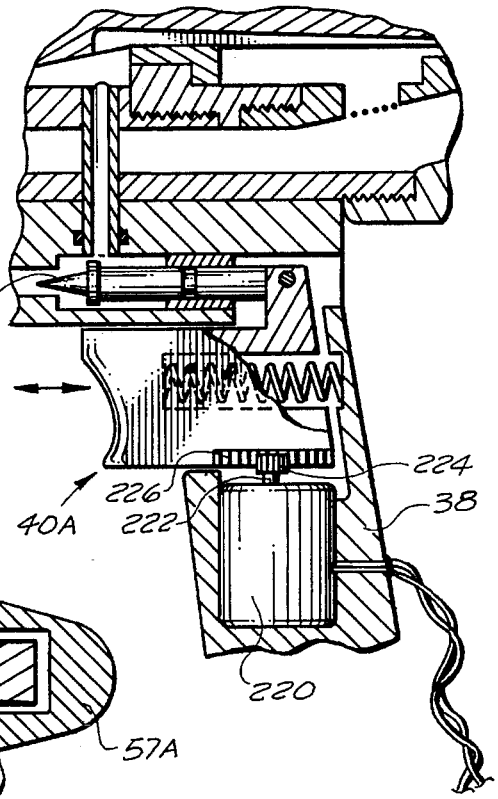
FIG. 20 is a fragmentary sectional view showing still another embodiment of the invention.

FIG. 20 shows an alternate trigger mechanism 40A which may replace the manually actuated trigger 40 in the embodiment of FIGS. 1–15 or the embodiment of FIGS. 17 and 22. As in the previous embodiments, the trigger 40A is movably mounted in the rear grip 38 of the gripping assembly 34 and mechanically coupled to the needle valve 90. Reciprocation of the trigger 40A is controlled by a motor 220 housed within the rear grip 38. The output shaft 222 of the motor 220 includes a number of gear teeth 224 which mesh with corresponding teeth 226 formed on the lower surface of the trigger 40A. The motor 220 is actuated by a remotely located switch, allowing a firefighter to operate the jet control valve 44 at a safe distance away from the fire.

Figure 19:
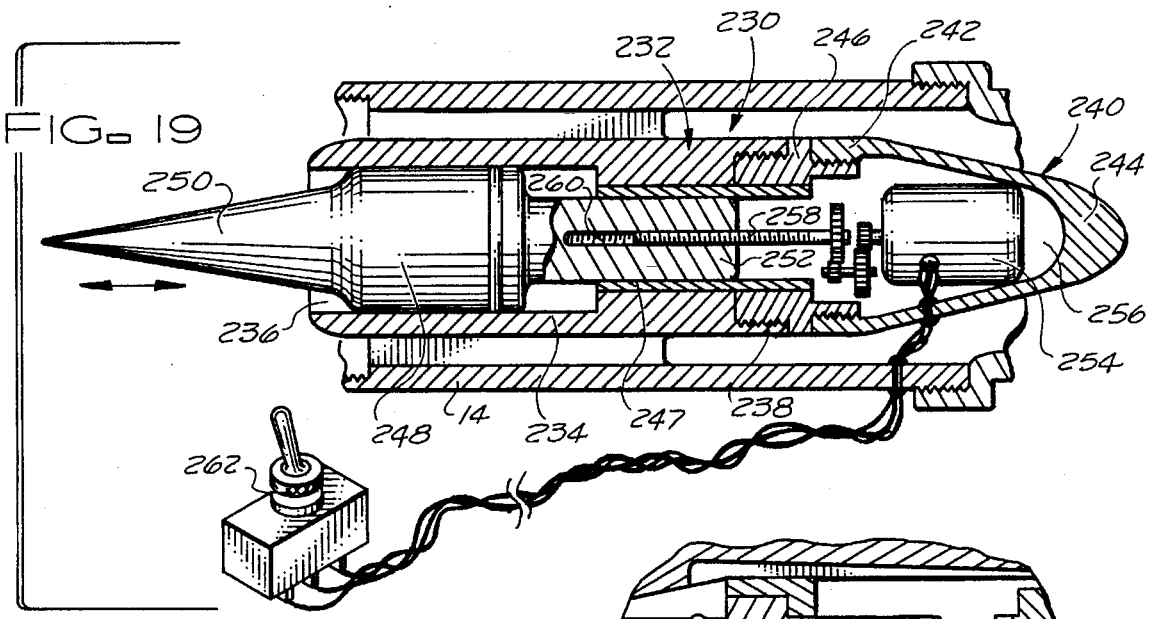
FIG. 19 is a sectional view showing yet another embodiment of the invention.

Finally, FIG. 19 shows an alternate, electrically operated jet control valve 230 which may replace the hydraulically operated jet control valve 44 of any of the previous embodiments. The valve comprises an interior valve housing 232 including a front member 234 having an open front end 236 and an internally threaded, open back end 238; a sealed rear member 240 having an internally threaded, open, front end 242 and a closed back end 244; and a central connector member 246 having both ends externally threaded for cooperation with the corresponding internally threaded ends of the front and rear members 234, 240. A sleeve bearing 247 is carried in the bore of the connector member 246.

A valve body 248 having a forwardly tapered front end 250 is mounted for longitudinal translation within the open front end 242 of the front member 234 of the valve housing 232. The valve body 248 includes an elongated tail portion 252 which extends rearwardly through the sleeve bearing 247.

An electric motor 254 is mounted within a chamber 256 formed in the rear member 240 of the interior valve housing 232. The output shaft of the motor 254 is coupled by several differential gears to a lead screw 258 which extends into a threaded bore 260 in the tail portion 252 of the valve body 248. Rotation of the lead screw 258 is converted to longitudinal movement of the valve body 248 toward and away from the valve seat, in a manner similar to the earlier embodiments. Activation of the motor 254 is controlled by a switch 262, which can either be located remotely, as shown, or mounted on a grip depending from the nozzle body 14.

FIGS. 24–30 show various embodiments of a foam induction system usable with the nozzle 10 of the present invention. In the following description the term "foam" is used loosely, and can be understood to mean foam concentrate or wetting or penetrating agents, or any other additive to be mixed with the primary firefighting fluid.

In each embodiment in FIGS. 24–30, the structure of the nozzle body 14 and the fog control valve 46 are essentially the same as in the previous embodiments. However, modifications have been made to the jet control valve 44A to allow foam to be induced along its centerline. Specifically, The operation of the fog control valve 46 is generally similar to the operation of the jet control valve 44. That is, the movement of the valve body 154 is controlled by varying the pressure in the hydraulic chamber 132. The pressure in the chamber 132 is controlled by a metering valve 162 mounted in a control passage 164 formed in the front grip 42 of the grip assembly 34. The control passage 164 communicates with both an outlet passage 166 extending from the hydraulic chamber 132 and a bleed passage 168 extending through the front grip 42 and the upper support bar 36. The bleed passage 168 terminates in an outlet 170, which allows water to exit as a forwardly directed stream.

In contrast to the needle valve 90 governing the jet control valve 44, which is mounted solely for longitudinal movement, the metering valve 162 for the fog valve 46 is rotatably mounted, and is retained within the front grip 42 by screw threads 172. The valve 162 is secured by set screws 174 to a twist actuator 43 mounted for rotation about the front grip 42. The screw threads 172 convert the twisting movement of the actuator to a longitudinal movement of the metering valve 162 toward or away from its seat 178. In addition, the screw threads 172 retain the valve 162 in its most recent position when the actuator 43 is released. Thus, the control valve 46 can remain open even when the nozzle 10 is dropped, so that the protective, cooling effects of the fog spray are not lost.

Figure 11:
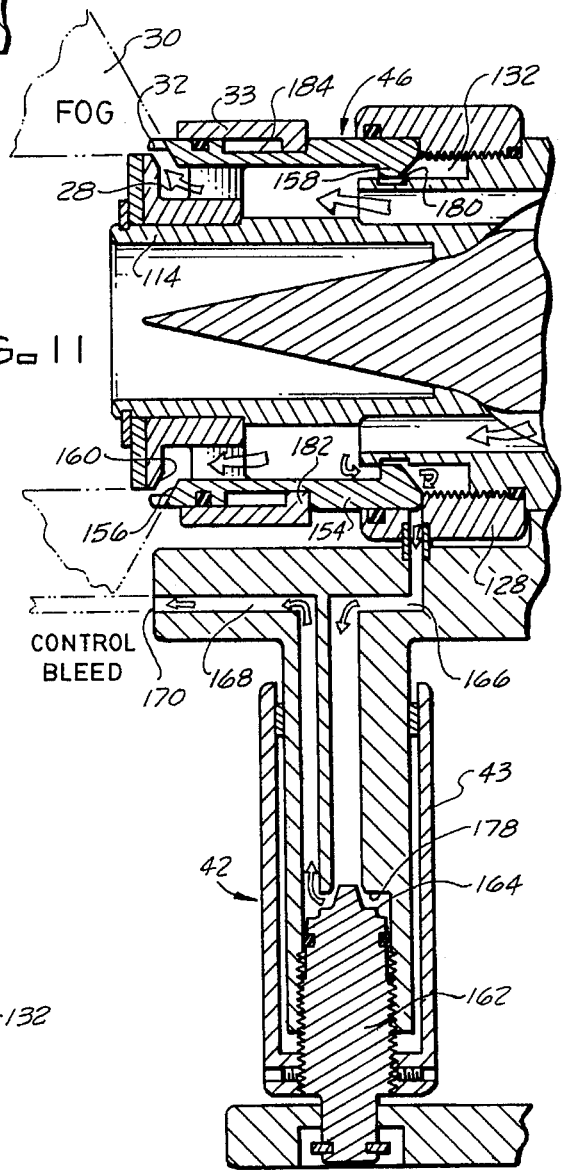
FIG. 11 is a view similar to FIG. 10, with the jet control valve closed, the fog control valve fully opened, and the shaper ring fully aft.

Operation of the fog control valve 46 may be understood by referring to FIGS. 10 and 11. When the valve is fully closed, as shown in FIG. 10, liquid entering the annular flow opening 28 through the bores 117 in the tip assembly 86 exerts a rearward pressure on the rear flange 158 of the valve body 154. This pressure is counteracted by forward pressure in the hydraulic chamber 132, causing the valve 46 to remain closed. However, as soon as the twist actuator 43 is rotated, causing the metering valve 162 to move away from its seat 178, the pressure in the hydraulic chamber 132 decreases, allowing the valve body 154 to move rearwardly. As the valve body 154 moves rearwardly, its rear flange 158 passes over a groove 180 formed in the front end of the boss 130 projecting from the main body 120. The clearance between the bottom edge of the flange 158 and the bottom wall of the groove 180 allows more liquid to flow into the hydraulic chamber 132, and then out again through the outlet passage 166 and bleed passage 168. At the same time, the tapered front surface 156 of the valve body 154 moves away from the valve seat 160 allowing liquid to exit from the fog orifice 28. Fluid exiting through the orifice 28 impinges on the forwardly directed teeth 32, which direct the flow in all directions, creating a conical "fog" 30 of evenly distributed droplets.

The included angle of the fog cone 30 may be selectively varied by manipulation of the shaper ring 33, which consists of an annular member having an inwardly extending flange 182 formed at its rear end. The flange 182 is disposed for sliding movement in a recess 184 extending in an annular direction around the valve body 154. Although not specifically illustrated, a control ring or lever may be provided on the shaper ring for allowing manual control of the shaper ring's movement. Such a ring or lever preferably depends from the underside of the shaper ring 33 and is readily accessible from the front grip 42, so that an operator can grasp it with a thumb or other finger, without removing his hand from the twist actuator 43.

Figure 12:
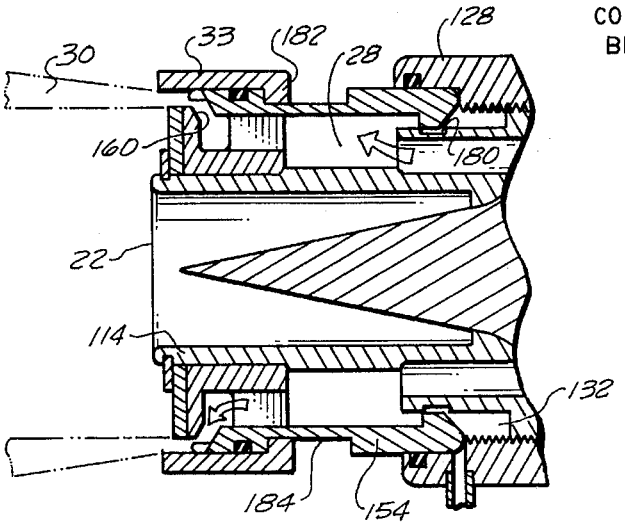
FIG. 12 is a view similar to FIG. 11, with the jet control valve closed, the fog control valve fully opened, and the shaper ring fully forward.

FIG. 11 shows the shaper ring 33 in its fully aft position, which results in the widest possible fog cone angle. FIG. 12 shows the shaper ring 33 in its fully forward position. In this position, the front end of the ring 33 projects forwardly, beyond the valve seat 160 and the front end 22 of the nozzle, thus forming a ceiling which narrows the fog cone to its minimum included angle. Other than this, the flow of liquid in FIG. 12 is exactly the same as in FIG. 11. The shaper ring 33 is mounted on the valve body 154 in such a way that the reaction forces created by the exiting liquid automatically force the ring 33 to the fully aft position shown FIG. 11 when the control lever is released, since the widest angle cone is safest.

Although FIGS. 10—12 show the fog valve 46 only in its fully open and fully closed position, and the shaper ring 33 fully forward and fully aft, it will be evident that both the fog valve 46 and the shaper ring 33 can be independently maintained in any position intermediate these extremes. It will also be evident that, although FIGS. 10—12 show the jet control valve 44 fully closed, the fog control valve 46 and shaper ring 33 can also be operated when the jet control valve 44 is fully open, or in an intermediate position. The state of the fog control valve 46 is not in any way dependent on the state of the jet control valve, and vice versa. Thus, an infinitely variable combination of discharge patterns is obtainable.

Figure 16:
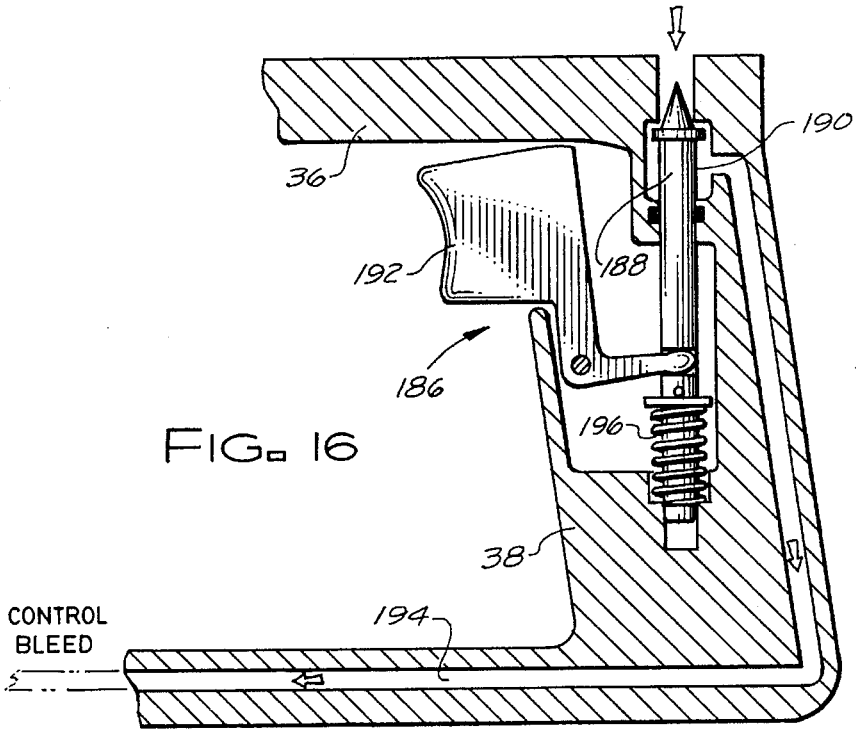
FIG. 16 is a fragmentary longitudinal cross-sectional view showing alternate actuation means for the jet spray control valve.

A modification of the actuator for the jet control valve is illustrated in FIG. 16. The operating principles behind the modified actuator 186 are the same as in the actuator of FIG. 5, except that the needle valve 188 and its control chamber 190 are coaxial with, rather than perpendicular to, the outlet passage 72, and the trigger 192 is mounted for pivoting movement in the rear grip 38. In addition, the relief duct 194 extends longitudinally through the bottom guard bar 44, rather than the top support bar 36. As in the previous embodiment, however, the needle valve 188 is biased by a spring 196 toward the closed position, so that the jet valve closes automatically when the trigger 192 is released.

FIGS. 17–23 show a variety of alternate embodiments which allow the nozzle 10 to be operated remotely, in situations where it would be too dangerous for personnel to approach the fire directly. Specifically, FIG. 17 shows the nozzle body 14 mounted on a pair of robotic arms 200, 202. The gripping assembly 34, rather than being directly secured to the nozzle body 14 as in the previous embodiments, is in the form of a separate unit connected to the nozzle by a pair of elongated pilot lines 204, 206. Although shown here as a hand-held device, the gripping assembly 34 could take a variety of different forms, and could be incorporated as part of a control unit mounted in the dashboard of a fire truck or as part of an externally located command post.

FIG. 22 is a fragmentary sectional view of the rear portion of the nozzle 10 according to the embodiment of FIG. 17, showing remote actuation of the jet control valve 44. The structure and operation of the valve 44 is exactly as described in connection with FIGS. 5 and 6, except that the outlet passage 72 from the front chamber 68 of the interior valve housing 48 is coupled to the control passage 92 of the rear pistol grip 38 by means of the elongated pilot line 204, rather than leading directly thereto. A similar remote control arrangement could also be devised in connection with the embodiment of FIG. 16.

Similarly, FIG. 23 is a fragmentary sectional view of the front portion of the nozzle 10 according to the embodiment of FIG. 17, showing remote actuation of the fog control valve 46. The structure and operation of the valve 46 is exactly as described in connection FIGS. 10 and 11, except for the addition of the pilot line 206, which essentially extends the length of the outlet passage 166 leading from the hydraulic chamber 132 in the tip assembly 86 of the nozzle 10 to the control passage 164 in the front grip 42.

the front end or tip 76A of the fog control valve 46A has been abbreviated to create a region of low pressure sufficient to draw foam from a container, and a foam passage 270 has been provided down the centerline of the valve body 74. The foam passage 270 includes an outlet end 272 at the distal end of the valve tip 76A and an inlet end 274 alignable with a foam tube 276 coupled to a foam channel 278 in the rear grip 38 of the handle assembly 34. Sealing rings 279, 280 are carried on the valve body 74 both upstream and downstream of the inlet end 274 of the foam passage 270, to prevent the foam concentrate and water from mixing upstream of the valve tip 76A.

Figures 24, 25:
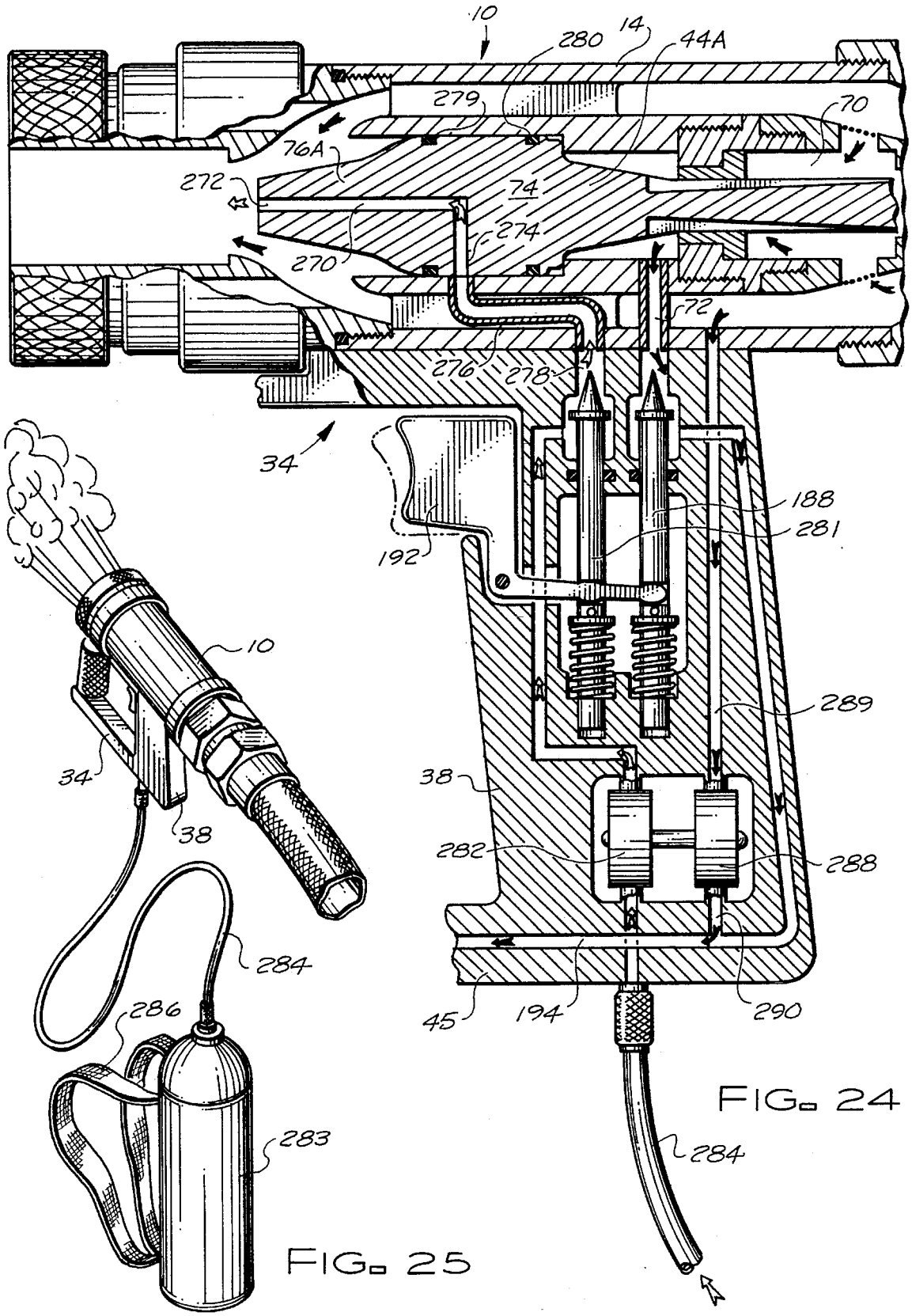
FIG. 24 is a sectional view of an alternate embodiment of the invention including a foam injection system.
FIG. 25 is a perspective view showing the nozzle and foam injection system of FIG. 24 in use.

In the embodiment of FIG. 24, the entry of foam into the foam tube 276 is controlled by a foam control needle valve 281, which is mechanically coupled to a trigger 192 similar to that shown in FIG. 16, and which moves in tandem with the needle valve 188 controlling the flow of water from the outlet passage 72 of the hydraulic chamber 70 of the jet spray valve 44A. This ensures that foam concentrate will be induced only when the jet spray valve 44A is open, and that the amount of foam concentrate induced will be proportional to the movement of the jet spray valve 44A.

A turbine pump or gear pump 282 mounted in the foam channel 278 draws the foam concentrate from a refillable foam tank 283 which is coupled to the rear grip 38 of the handle assembly 34 by a quick-connect hose 284, as shown in FIG. 25. The foam tank 283 preferably includes shoulder straps 286, allowing it to be carried on the back of a fireman or an assistant.

The pump 282 is powered by a miniature water-driven motor 288 mounted in the rear grip 38. The drive water for the motor 288 is carried by a supply passage 289 leading from the upstream end of the nozzle 14. Waste water from the motor 288 is carried by a waste passage 290 into the relief duct 194 in the bottom guard bar 45 of the handle assembly 34.

Operation of the nozzle 14 and foam injection system is as follows. When the trigger 192 is squeezed, the needle valves 188 and 280 open, uncovering the outlet passage 72 of the hydraulic chamber 70 and the inlet end of the foam tube 276 simultaneously. The opening of the outlet passage 72 causes the valve body 74 to move toward its aft position, as described in connection with the earlier embodiments, and causes the foam passage 270 to move into alignment with the foam tube 276. This allows foam concentrate to be sucked up from the tank 283, through the foam channel 278, and out through the foam passage 270, where it mixes with the water at the tip of the valve body 74. The flow rate of the foam concentrate is determined by the degree of alignment between the foam passage 270 and the foam tube 276, which in turn is determined by the amount of pressure exerted on the trigger 192. Thus, the amount of foam will always be proportional to the amount of water being sprayed, since both are controlled by movement of the same trigger.

When the trigger 192 is released, the needle valves 188 and 280 move back into their closed positions, causing the valve body 74 to move to its fore position, and the foam passage 270 to move out of alignment with the foam tube 276. As a result, the induction of the foam concentrate and the discharge of the water are stopped simultaneously.

Figure 26:
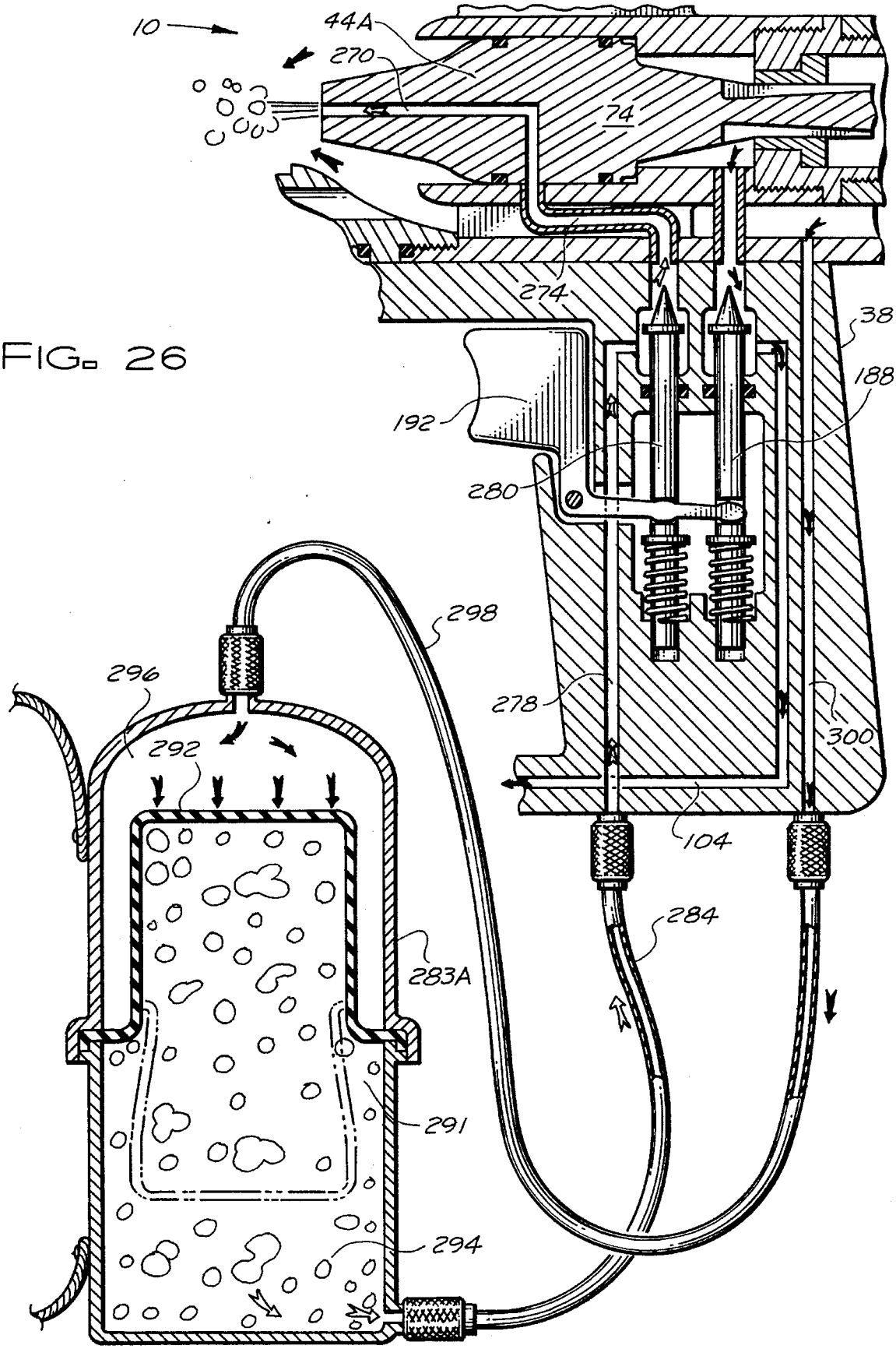
FIG. 26 is a sectional view showing an alternate embodiment of the foam injection system.

FIG. 26 shows an alternate embodiment of the foam injection system in which the basic operation of the jet control valve 44A and needle valves 280, 188 is the same, but the pump 282 and motor 288 have been eliminated. Instead, the foam concentrate 291 is forced out of the tank 283A and through the foam channel 278 by a convoluted diaphragm 292 mounted in the tank 283A. The diaphragm 292 divides the tank into a lower compartment 294, which contains the foam concentrate 291, and an upper compartment 296, which receives water from a quick connect hose 298 leading from a drainage passage 300 in the rear grip 38 of the nozzle 10. As long as the needle valve 280 is closed, the pressure on both sides of the diaphragm 292 is equal. However, as soon as the needle valve 280 is open, the pressure in the lower compartment 294 of the tank 283A drops, causing the water in the upper compartment 296 to push the diaphragm downwardly, forcing the foam concentrate 291 out through the hose 284, the foam channel 278, and the foam passage 270. When the needle valve 280 closes, the pressure in the tank 283A equalizes again, causing the diaphragm 292 to stop moving and ending the discharge of the foam.

Figures 27, 28, 29, 30:
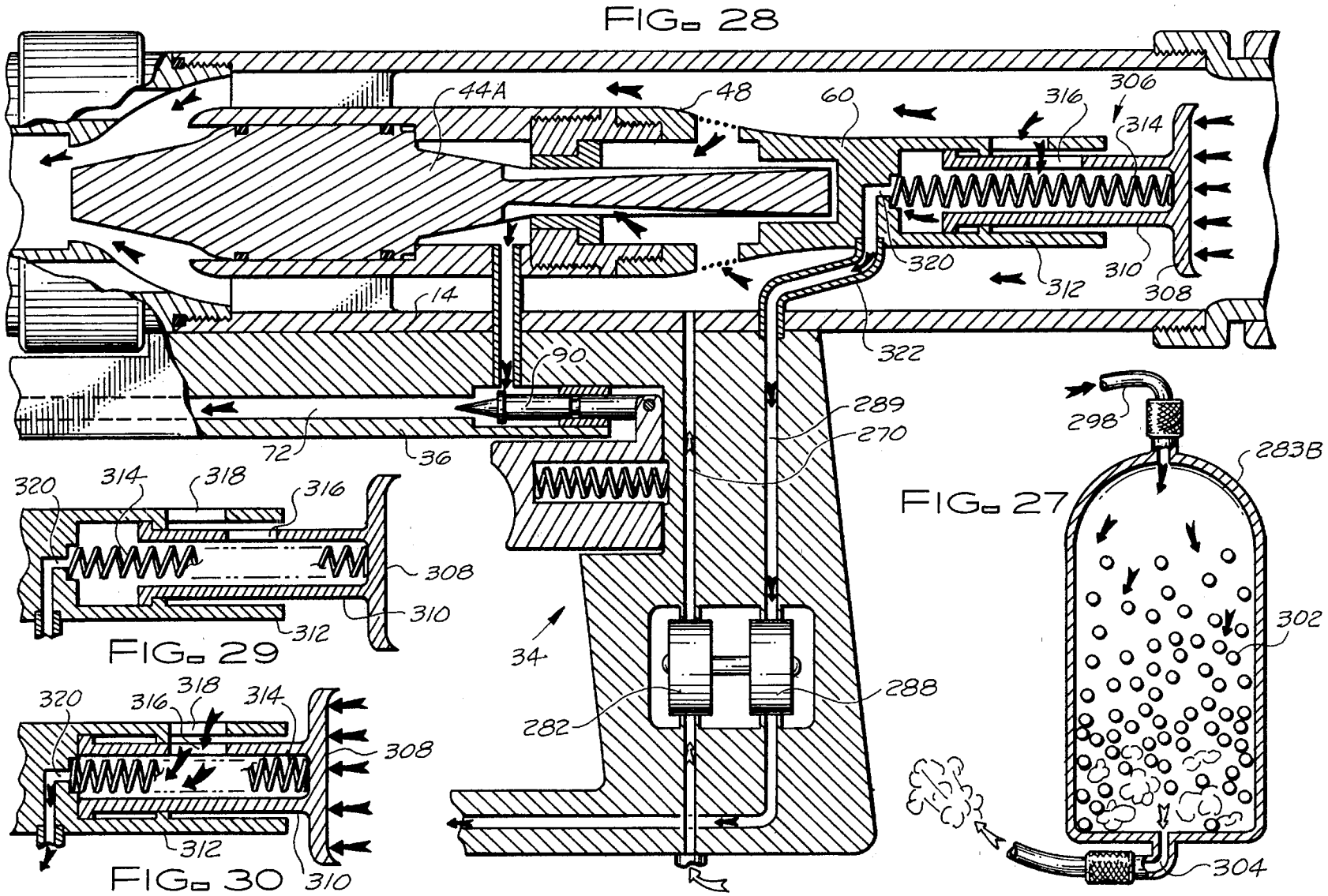
FIG. 27 is a sectional view showing an alternate embodiment of a foam tank usable with the foam injection system.
FIG. 28 is a sectional view showing another alternate embodiment of the nozzle and foam injection system.
FIG. 29 is a sectional view showing a closed stagnation valve used with the nozzle and foam injection system of FIG. 28.
FIG. 30 is a sectional view, similar to FIG. 29, showing the stagnation valve in an open position.

FIG. 27 shows an alternate foam tank 283B, which contains solid foam pellets 302 rather than liquid foam concentrate. When water from the hose 298 coupled to the drainage tube 300 enters the tank 283B, it dissolves the pellets 302, forming a pressurized, foam-rich mixture which exits the tank 283B through the bottom outlet 304 and is reinjected into the water stream as in the previous embodiments.

FIG. 28 shows an alternate arrangement for controlling the foam induction system. This is similar to the embodiment of FIG. 24 except that the needle-type metering valve 90 which actuates the jet control valve 44A is coaxial with the outlet passage 72 in the upper support bar 36 of the gripping assembly 34, as in the embodiment shown in FIGS. 4 and 5. In addition, instead of a second needle valve, a stagnation valve 306 is provided for controlling the flow of foam into the nozzle.

The stagnation valve 306 comprises a stagnation disc 308 located at the nozzle inlet 16 at the stagnation point. The disc 308 is formed at the upstream end of a piston rod 310, which is mounted for reciprocation in a cylinder 312 integrally formed at the back end 60 of the interior valve housing 48 of the jet control valve 44A. A coil spring 314 carried in the cylinder 312 urges the stagnation disc towards its equilibrium position at the inlet 16 of the nozzle. A first inlet port 316 is formed in the sidewall of the piston rod 310, and a second inlet port 318 is formed in the sidewall of the cylinder 312, downstream of the first inlet port 316. An outlet port 320 is formed in the downstream wall of the cylinder 312. The outlet port 320 is coupled to a tube 322 leading to the supply passage 289 for conducting drive water into the water motor 288 which powers the pump 282.

When the nozzle 10 is off, meaning there is no flow of water, the pressure on both sides of the stagnation disc 308 is equal, so the disc 308 remains in its equilibrium position, shown in FIG. 29. When the disc 308 is in this position, there is no flow of water through the inlet ports 316 and 318 or outlet port 320, and thus no supply of drive water for the water motor 288.

However, as soon as flow begins, the pressure on the upstream face of the disc increases, causing the piston rod 310 to move forward. As the rod 310 moves forward, the first inlet port 316 moves into alignment with the second inlet port 318, allowing water to enter the cylinder 312 and flow out through the outlet port 320. The water then travels through the supply passage 289 to the water motor 288, actuating the motor 288 which in turn drives the pump 282. The speed of the pump 282, and thus the flow rate of the foam concentrate, is therefore determined by the degree of alignment between the first and second inlet ports 316 and 318, with the maximum occurring at the fully open position of the stagnation valve, shown in FIG. 30. When the valve 306 is between the fully closed position, shown in FIG. 29, and the fully open position, shown in FIG. 30, the flow of foam is proportional to the flow of water through the nozzle 10.

Although the foam outlet passage 270 is shown extending through the centerline of the valve body 44A, it is not strictly necessary for the foam to be discharged through the valve body 44A in this embodiment. The foam may also end at a point 324 within the outer housing 14 of the nozzle.

Figure 31:
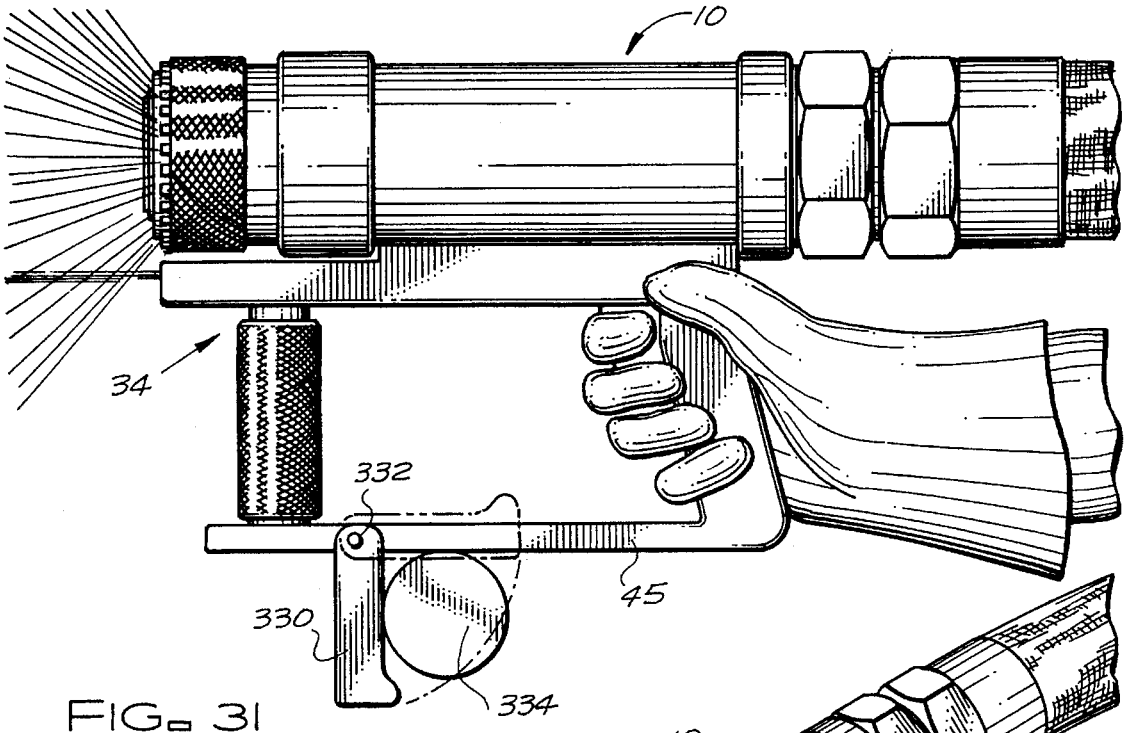
FIG. 31 is a side view showing an embodiment of the invention incorporating a folding arm for securing the nozzle to a fixed sur face.
Figure 32:
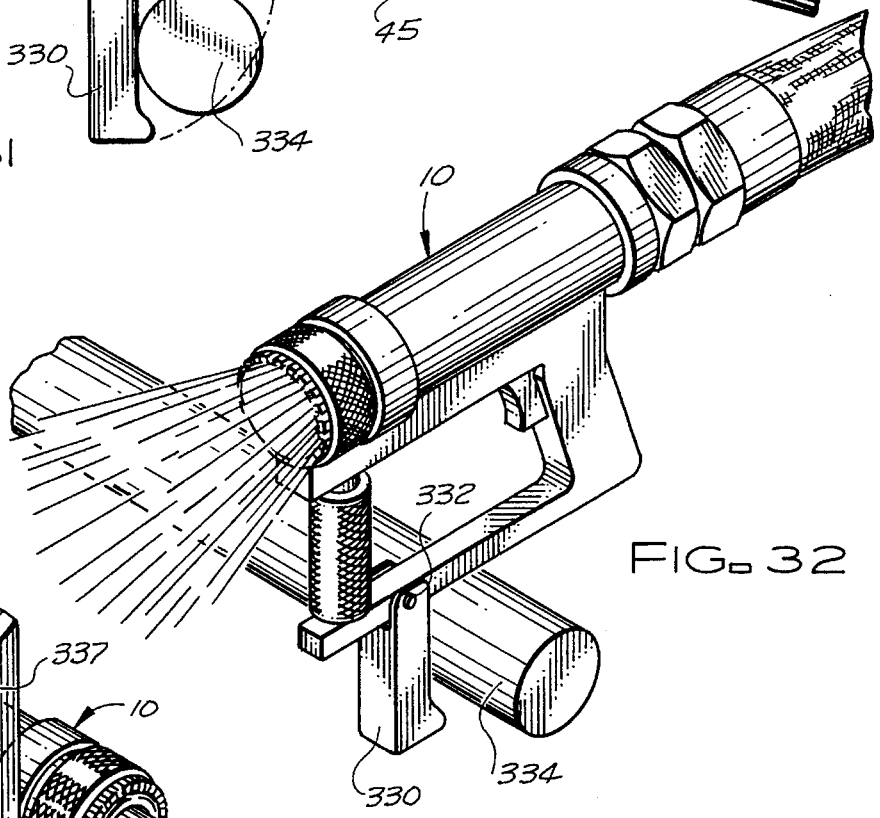
FIG. 32 is a perspective view of the nozzle shown in FIG. 31.

Turning now to FIGS. 31 and 32, an accessory for relieving a firefighter from high reaction forces is shown. The accessory is in the form of a hook 330 carried on the lower guard bar 45 of the gripping assembly 34. The hook 330 is mounted for pivoting movement about a pin 332 extending through the guard bar 45, from a stowed position flush with the guard bar 45 to a deployed position extending perpendicularly and downwardly from the guard bar 45. When in the deployed position, the hook 330 may be latched onto any convenient stationary surface such as a windowsill or ladder rung 334, as shown in FIG. 32, to help hold the nozzle 10 in place. A portion of the reaction forces from the spray is thus transmitted to the surface 334, reducing or eliminating the force absorbed by the firefighter.

Figure 33:
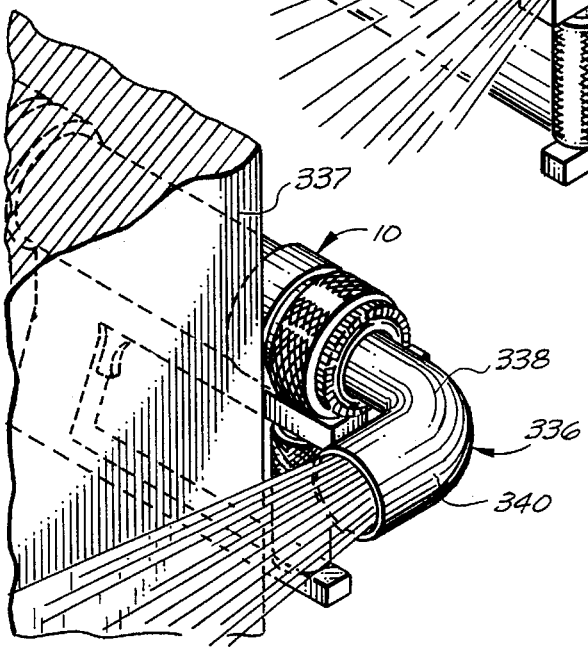
FIG. 33 is a perspective view showing the nozzle with an attachment for spraying around corners.

FIGS. 33–35 show an attachment which may be added to the outlet end 22 of the nozzle 10 to allow a firefighter to spray around a corner 337 or other obstruction. The attachment comprises a rigid deflection tube 336 which has been curved or bent to define a rear portion 338 coaxial with the nozzle 10 and a front portion 340 extending at an angle to the rear portion 338. The deflection tube 336 is coupled to the nozzle outlet 22 by a pin 342 which extends through an opening 344 in the rear portion 338 of the tube and is received in an annular groove 346 formed in the inner surface of the outlet tube 114 of the nozzle 10. The pin 342 is carried at the free end of a leaf spring 348 mounted in the inner surface of the deflection tube 336. A release button 350 provided between the pin 342 and the fixed end of the leaf spring 348 projects though a second opening 352 in the tube 336. To attach the deflection tube 336 to the nozzle, it is simply necessary to push down on the button 350 and push the tube 336 into place. When the button 350 is released, the leaf spring 348 forces the pin into the annular groove 346, locking the tube 336 against longitudinal movement. To detach the tube 336, it is necessary to again push down on the button 350, freeing the pin 342 from the annular groove 346, and pull the tube 336 in an outward direction. Other couplings, such as quick-disconnect types, may also be used in place of that shown.

FIGS. 36–40 show another accessory which facilitates aiming the nozzle 10 in a desired direction. The accessory is in the form of a jointed member 356 for attachment between the nozzle 10 and the fire hose 20. The Jointed member 356 comprises three tubular segments 357, 358, 359 rotatably coupled to one another. The front segment 357 includes a threaded front end 360 for attachment to the inlet of the nozzle 10, and a rear end 362 having a surface disposed at 45 degrees to the axis of the nozzle 10. The front and rear ends 364, 366 of the central segment 358 are also disposed at 45 degrees to the nozzle axis, and at 90 degrees to one another. The front end 368 of the rear segment 359 is angled to mate with the rear end of the central segment 358, and the rear end 370 of the rear segment 359 is threaded for attachment to the outlet end of the fire hose 20.

Each of the angled ends 364, 366 of the central segment 358 is joined to its respective mating end 362, 368 of the front and rear segments 357, 359 by a flanged coupling ring 372, which extends through aligned openings 374, 376 in the ends, as best shown in FIG. 38. A set of ball bearings 378 is captured between each of the flanges 380 of the coupling ring 372 and the corresponding segment end 357, 359. In addition, a sealing ring 382 is interposed between the coupling ring 372 and the perimeter of the openings 374, 376, to prevent leakage between segments.

Finally, FIG. 41 shows a stiffening rod 386 which may be grasped by a hook or robotic arm (not shown) to carry the hose 20 to an otherwise Inaccessible place, such as through a false ceiling 388. The front end 390 of the stiffening rod 386 is received in a special casting 392 formed on the body of the nozzle 10. The rear end 394 of the rod 386 is secured to the hose 20 by a flexible strap 396.

Various modifications and variations to the embodiments herein chosen for purposes of Illustration will readily occur to those skilled In the art. To the extent that such variations and modifications do not depart from the spirit of the invention, they are intended to be included within the scope thereof which is assessed only by a fair interpretation of the following claims.

Having fully described and disclosed the instant invention and alternately preferred embodiments thereof in such clear and concise terms as to enable those skilled In the art to understand and practice the same, the invention claimed is:

1. A firefighting nozzle comprising a hollow nozzle body having:

a) an open inlet end for receiving liquid from a hose at a variable rate of flow;

b) an outlet end including a jet orifice, for discharging at least a portion of said liquid in the form of a circular solid stream having a variable diameter;

c) jet control means disposed within said jet orifice for selectively varying said diameter, said jet control means including i) a valve body mounted for longitudinal translation within said nozzle body, ii) a valve seat formed proximate said outlet end of said nozzle body, and iii) drive means for moving said valve body relative said valve seat to vary said diameter;

d) a grip for facilitating handling of said nozzle; and e) foam injection means for injecting foam concentrate into said solid stream at a low pressure point within said nozzle body, said foam injection means including i) a reservoir containing the foam concentrate, ii) passage means for conveying said foam concentrate from said reservoir to said nozzle, said passage means including an inlet communicating with said reservoir and an outlet located within said nozzle body, iii) a discharge assistant for driving said foam concentrate out of said reservoir, through said passage means, and out said outlet, the discharge assistant including a pump located within said grip, and drive means for driving said pump, and iv) foam control means for selectively controlling the injection of said foam concentrate into said stream.

2. The nozzle according to claim 1, wherein said reservoir comprises a portable foam tank.

3. The nozzle according to claim 2, wherein said passage means comprises a quick-connect hose coupling said tank to said nozzle body.

4. The nozzle according to claim 1, wherein:

a) said valve body is symmetrical about a center line; and b) said outlet is located along said center line.

5. The nozzle according to claim 1, wherein said drive means comprises a motor located within said grip.

6. The nozzle according to claim 5, wherein:

a) said nozzle includes means for diverting a portion of said liquid from said nozzle body; and b) said motor is a water-powered motor driven by the portion of the liquid diverted from the nozzle body.

7. The nozzle according to claim 1, further comprising actuator means utilizing fluid pressure to actuate said jet control means.

8. The nozzle according to claim 7, wherein:

a) said jet control means includes
an interior housing carried within said nozzle body and defining a hydraulic chamber;

b) said valve body is mounted for longitudinal translation within said hydraulic chamber and includes a rear surface subject to forward pressure from a fluid in said hydraulic chamber; and c) said actuator means comprises i) inlet means in said interior housing for admitting said fluid into said hydraulic chamber, ii) an outlet passage for discharging said fluid from said hydraulic chamber at a flow rate, and iii) secondary valve means for selectively varying said flow rate through said outlet passage.

9. The nozzle according to claim 8, wherein said foam control means comprises a foam valve movable with said secondary valve means, for allowing induction of said foam concentrate only when said secondary valve means is open, said foam concentrate entering said nozzle body at a flow rate proportional to the flow rate of said liquid through said outlet passage.

* * * * *